US006253804B1

(12) United States Patent
Safabash

(10) Patent No.: US 6,253,804 B1
(45) Date of Patent: Jul. 3, 2001

(54) NEEDLE SAFE TRANSFER GUARD

(75) Inventor: Jason Hossein Safabash, Los Angeles, CA (US)

(73) Assignee: MiniMed Inc., Northridge, CA (US)

( * ) Notice: Subject to any disclaimer, the term of this patent is extended or adjusted under 35 U.S.C. 154(b) by 0 days.

(21) Appl. No.: 09/434,648

(22) Filed: Nov. 5, 1999

(51) Int. Cl.[7] ..... B65B 1/04; B65B 3/04; B67C 3/02

(52) U.S. Cl. ..... 141/97; 141/311 R; 141/319; 141/329; 141/330; 141/346; 141/363; 141/364; 141/365; 141/366; 141/369; 141/383; 141/384; 604/411; 604/412; 604/413; 604/416

(58) Field of Search ..... 141/311 R, 319, 141/329, 330, 346, 351, 357, 97, 363–366, 369, 382–386; 604/192, 201, 403, 411, 412, 413, 416

(56) References Cited

U.S. PATENT DOCUMENTS

| | | | | |
|---|---|---|---|---|
| 3,993,063 | | 11/1976 | Larrabee | 128/215 |
| 4,564,054 | * | 1/1986 | Gustavsson | 141/329 |
| 4,576,211 | * | 3/1986 | Valentini et al. | 141/329 |
| 5,312,366 | * | 5/1994 | Vailancourt | 604/192 |
| 5,356,406 | | 10/1994 | Schraga . | |
| 5,445,631 | * | 8/1995 | Uchida | 604/412 |
| 5,954,104 | | 9/1999 | Daubert . | |

FOREIGN PATENT DOCUMENTS

| | | | |
|---|---|---|---|
| 2160668 | 11/1972 | (FR) | A61M/5/00 |
| 2560049 | 2/1985 | (FR) | A61M/5/00 |

OTHER PUBLICATIONS

Disetronic, "Instructions For Use", pp: cover–5.

* cited by examiner

*Primary Examiner*—Timothy L. Maust
(74) *Attorney, Agent, or Firm*—MiniMed Inc.

(57) ABSTRACT

A transfer guard for use by an individual for transferring contents from a supply container into a receiver container includes a supply adapter, a receiver adapter, a support structure and a needle. The supply adapter connects the supply container to the transfer guard, and the receiver adapter connects the receiver container to the transfer guard. The support structure couples the supply adapter with the receiver adapter, and the needle passes through the supply adapter and the receiver adapter. The needle is attached to one of the adapters for support and provides a passage for the contents to transfer from the supply container into the receiver container. The needle also includes at least one pointed end that is substantially protected by the transfer guard from contact with the user.

18 Claims, 20 Drawing Sheets

NEEDLE SAFE TRANSFER GUARD

FIELD OF THE INVENTION

This invention relates to needle safe transfer devices and, in particular embodiments, to a medication transfer device that transfers fluid from a vial to a reservoir using a needle.

BACKGROUND OF THE INVENTION

Traditionally, syringes are filled manually using a technique that requires the use of two hands, a syringe with a needle, and a vial. The process begins by drawing air into the body of the syringe, by pulling the plunger away from the needle end of the syringe until the volume of air in the body equals the volume of medication to be loaded into the syringe. The exposed needle is carefully aligned with a septum on the top of the vial and then inserted through the septum. The vial is turned upside down so that the medication covers the top of the vial and the depth of the needle is adjusted in the vial so that the needle tip is surrounded by the medication. Next, air is forced from the body of the syringe into the inverted vial, by pushing the plunger toward the needle end of the syringe until it is stopped at the end of the body. The user continues to hold the vial and the syringe in one hand, while using the other hand to pull back the plunger to draw out the desired volume of medication into the body of the syringe. Finally, the needle is pulled out of the vial and exposed. This process is generally conducted many times a day by care-givers, such as doctors and nurses, in care facilities, such as hospitals, nursing homes, or the like. It is also often carried out by patients at home that administer their own medication injections or use refillable infusion pumps.

One drawback to this method of filling a syringe is the user's exposure to an unprotected needle tip. Care-givers and patients can be pricked or stabbed by needles during the filling process or when disposing of the syringe needle. Generally, the exposure occurs twice during the filling process. First, when the protective needle cap is removed before inserting the needle into the vial; and second, when removing the needle from the vial. Typically the vial is held by hand while the needle is pushed through the septum. Thus, if the needle is misdirected to either side of the septum, the user could inadvertently drive the needle tip into the hand holding the vial. The potential of stabbing oneself with the needle increases when patients are in a weakened state or are shaky when they need to insert the needle through the septum. Second, unintentional needle pricks can also occur when pulling the needle from the vial, at which point the consequences of the user stabbing oneself may be greater, since the syringe contents may not be safe for the care-giver.

An additional drawback to filling a syringe using the conventional method is the difficulty of keeping the needle in the vial, while simultaneously holding both the vial and the syringe and then pulling the plunger back to draw out the medication. Also, as the amount of medication in the vial decreases, it may be difficult to keep the needle tip at the appropriate depth within the vial during filling so that the tip of the needle is always completely surrounded by the medication to avoid drawing air back into the syringe.

To overcome some of these drawbacks, stabilizing devices, such as the EasyFill device from Disetronic of Sweden, have been used to support the syringe and vial. For instance, a syringe with a filling needle is slid sideways into the EasyFill device and held in place with semicircular tabs. After the needle is inserted into a septum of a vial, additional semicircular tabs on the EasyFill device slide over and around the outside of the top of the vial. This makes it easier to hold the syringe, needle, and vial, while filling the syringe with medication from the vial. However, there are still drawbacks to using the EasyFill device. For example, once the protective cap is removed from the filling needle in preparation for insertion into the vial, the needle tip is exposed beyond the end of the EasyFill device and potentially could stab the user. In addition, the needle must still be carefully aligned with the septum in the top of the vial before inserting the filling needle. Also, when the EasyFill device is fully engaged with the vial, the tip of the filling needle is often inserted too deeply into the vial so that some of the medication can not be drawn out from the vial, resulting in wasted medication. Finally, once the filling needle is removed from the vial, the needle tip is exposed a second time so that the user can be inadvertently pricked or stabbed by the filling needle.

SUMMARY OF THE DISCLOSURE

According to an embodiment of the invention, a transfer guard is for use by an individual for transferring contents from a supply container into a receiver container and includes a supply adapter, a receiver adapter, a support structure and a needle. The supply adapter connects the supply container to the transfer guard, and the receiver adapter connects the receiver container to the transfer guard. The support structure couples the supply adapter with the receiver adapter, and the needle passes through the supply adapter and the receiver adapter. The needle is attached to one of the adapters for support and provides a passage for the contents to transfer from the supply container into the receiver container. The needle also includes at least one pointed end that is substantially protected by the transfer guard from contact with the user.

Other embodiments include a locking mechanism that may be engaged to keep the adapters from moving apart from each other. Still further embodiments include a locking mechanism to keep the adapters from moving closer to each other.

In particular embodiments of the present invention, the support structure facilitates moving the adapters closer or farther from each other. For instance, the support structure can include hinges that fold to facilitate the movement of one adapter with respect to the other adapter. In other embodiments, the support structure includes bands that bend to move one adapter in closer proximity to the other adapter. Alternatively, the support structure may be a foam member that is compressible, allowing one adapter to be moved closer to the other adapter.

Further alternative embodiments use a support structure that is formed by at least two threaded parts that are screwed together to move one adapter in closer proximity to the other adapter. In still other alternative embodiments, the support structure includes at least two parts, where one of the parts has at least one slot and another of the parts has at least one pin that slides in the slot to move one adapter closer to the other adapter.

According to another embodiment, the transfer guard is for use by an individual to transfer contents from a supply container into a receiver container that has a needle. The transfer guard includes a supply adapter, a receiver adapter and a support structure. The supply adapter connects the transfer guard to the supply container. The receiver adapter connects the transfer guard to the receiver container and/or needle (and/or a related needle support structure that is attached to the receiver container). The transfer guard support structure couples the supply adapter and the receiver adapter. In particular embodiments, once the receiver container is attached to the transfer guard, the needle tip is protected from contact with the individual by the transfer guard through out the process of filling the receiver container with contents from the supply container.

Further embodiments include a support structure that facilitates moving the adapters closer or farther from each other. The support structure may include hinges that fold to move one adapter closer to the other adapter.

Still further embodiments include a locking mechanism to keep the adapters from moving apart from one another, and other embodiments include a locking mechanism to keep the adapters from moving closer to each other.

According to yet another embodiment of the invention, a transfer guard is for use by an individual for transferring contents from a supply container into a receiver container and includes a supply adapter, a receiver adapter, a support structure and a fluid conducting element. The supply adapter connects the supply container to the transfer guard, and the receiver adapter connects the receiver container to the transfer guard. The support structure couples the supply adapter with the receiver adapter. The fluid conducting element provides fluid communication through the supply and receiver adapters in order to establish a passage for contents to move from the supply container into the receiver container. In particular embodiments, the fluid conducting element is a needle that is attached to one of the adapters for support.

According to other embodiments of the invention, a transfer guard is for use by an individual for transferring contents from a supply container into a receiver container through a fluid conducting element that is protected from contact with the individual. The transfer guard includes a supply adapter, a receiver adapter, and a support structure. The supply adapter connects the supply container to the transfer guard, and the receiver adapter connects the receiver container to the transfer guard. The support structure couples the supply adapter with the receiver adapter, and facilitates movement of the adapters from a position farther away from each other to a position that the adapters are in closer proximity to each other. In particular embodiments, the support structure includes hinges that fold to move the adapters in closer proximity to each other. Alternative embodiments include a support structure that has a locking mechanism that may be used to keep the adapters from moving away from each other.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

FIG. 1(*b*) is an exploded perspective view of a reservoir of FIG. 1(*a*).

FIG. 5(*b*) is a side view of the transfer guard of FIG. 4 in the expanded position.

FIG. 17(*b*) is a perspective view of the transfer guard of FIG. 17(*a*) in a compressed position.

DETAILED DESCRIPTION OF THE PREFERRED EMBODIMENTS

Figure 1A:
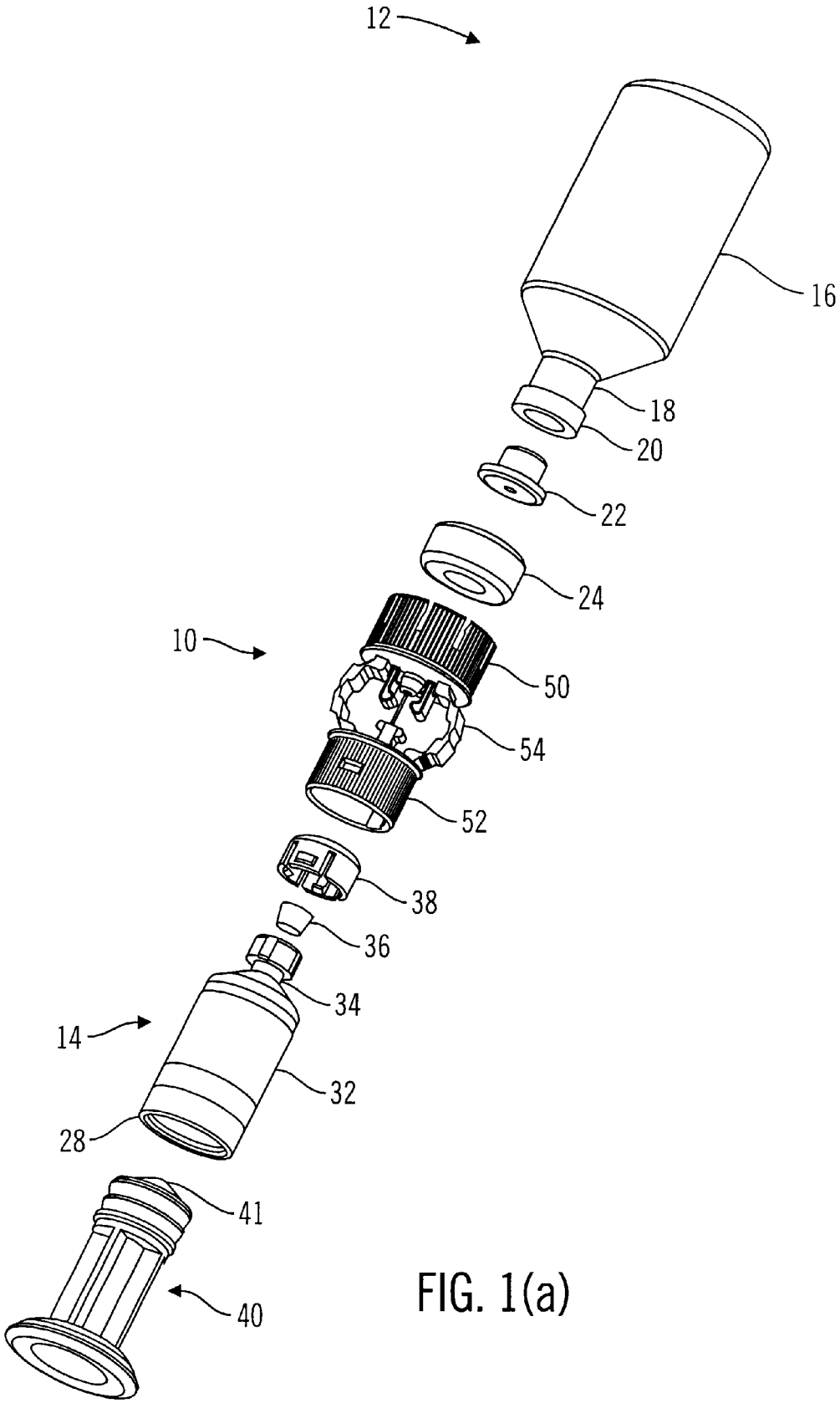
FIG. 1(*a*) is an exploded perspective view of a system including a reservoir, a transfer guard and a vial oriented for assembly in accordance with an embodiment of the present invention.

As shown in the drawings for purposes of illustration, the invention is embodied in a transfer guard for use by an individual for transferring contents by a needle from a supply container into a receiver container. Particular embodiments are directed toward transferring a fluid such as medication, chemicals, enzymes, antigens, hormones, vitamins, or the like, from one container to another. However, in alternative embodiments, other contents may be transferred such as syrups, serums, gels, pastes, encapsulated materials, lyophilized compounds, and powders. In preferred embodiments, the supply container is a vial of the type generally encountered for containing medication and the receiver container is an infusion pump reservoir. However, in alternative embodiments, either container may be a vial, reservoir, syringe, cartridge, bottle, bag or the like. In preferred embodiments, a hollow filling needle is used to transfer the fluid. However, in alternative embodiments, other fluid conducting elements, such as capillaries, cannulas, conduits, lumens, or the like, may be used. Preferred embodiments are for use in transferring liquids for medical purposes; however, other embodiments may be used for other fluid transfer purposes where generally sharp fluid transfer elements are used.

In preferred embodiments of the present invention, the transfer guard protects needle tips from contact with the user, supports the vial and reservoir so that they become a single assembly; and positions the needle to penetrate the vial septum to create fluid communication between the vial and reservoir so that a user can transfer medication from the vial into the reservoir. For instance, as the user securely attaches the reservoir to the transfer guard, the filling needle enters the reservoir. Then the user attaches the vial to the transfer guard. After attachment, the transfer guard is compressed to cause the filling needle to pierce a septum in the top of the vial to complete the fluid flow path. The compressed transfer guard, attached reservoir, and attached vial produce an assembly that can be held by one hand during the filling process. Next, the user operates a plunger inside the reservoir to transfer the fluid. When the transfer is complete, the reservoir is removed. In alternative embodiments, the transfer guard may be adapted to receive a reservoir equipped with its own filling needle, such as a standard syringe needle, or the like.

Figure 1B:
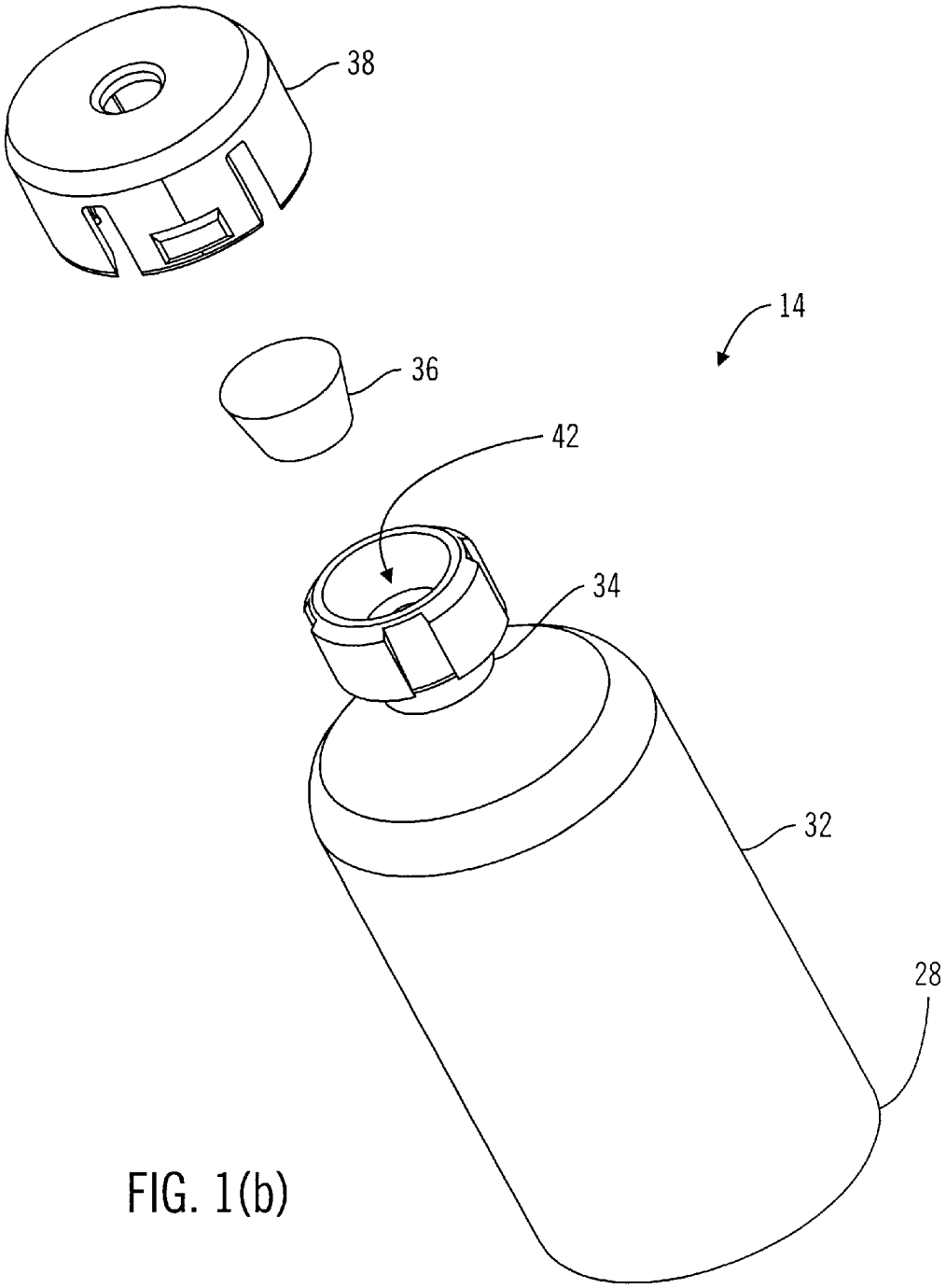
Figure 2:
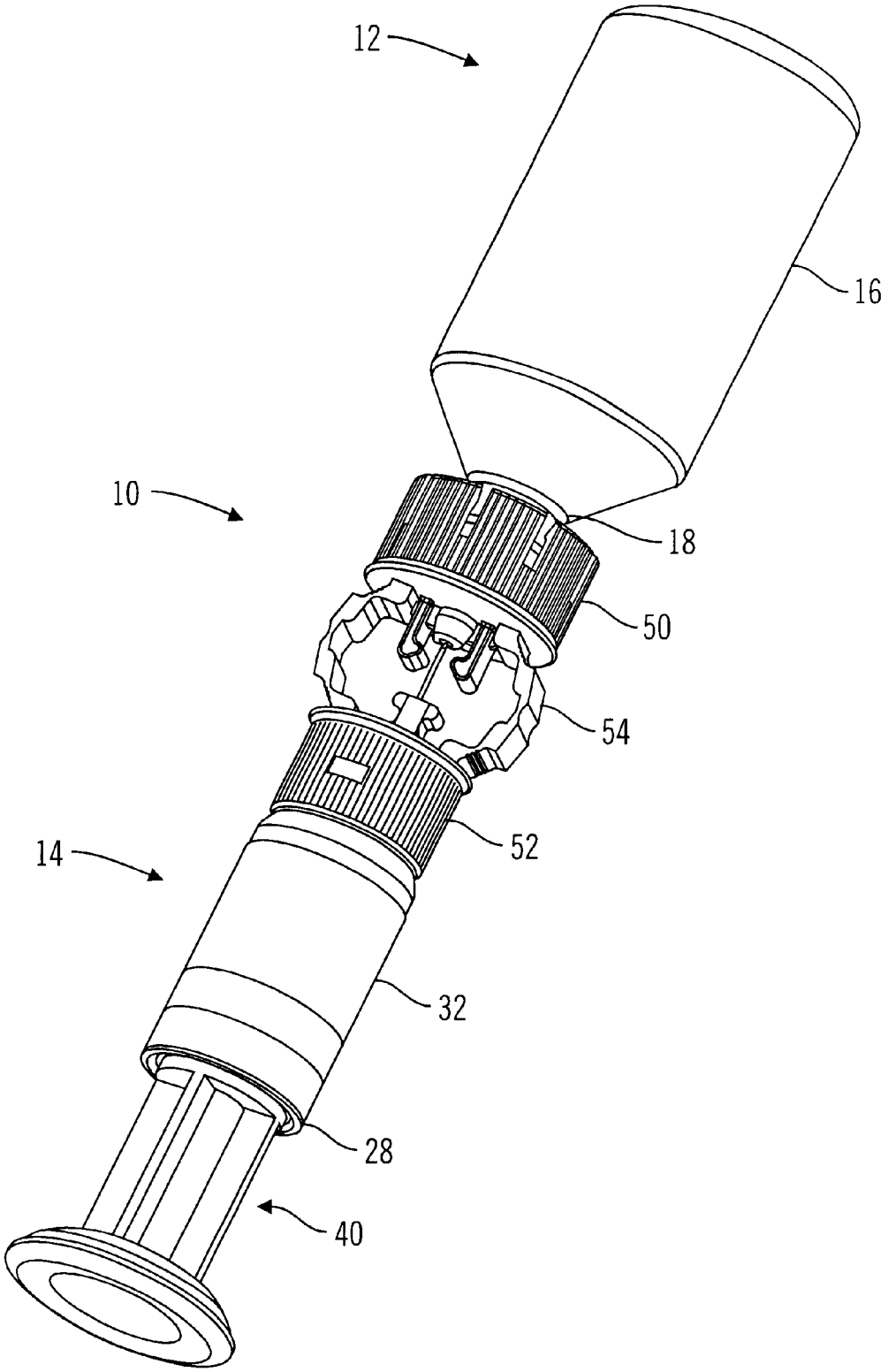
FIG. 2 is a perspective view of the system including the reservoir, the transfer guard and the vial of FIG. 1 assembled together with the transfer guard in an extended position.
Figure 3:
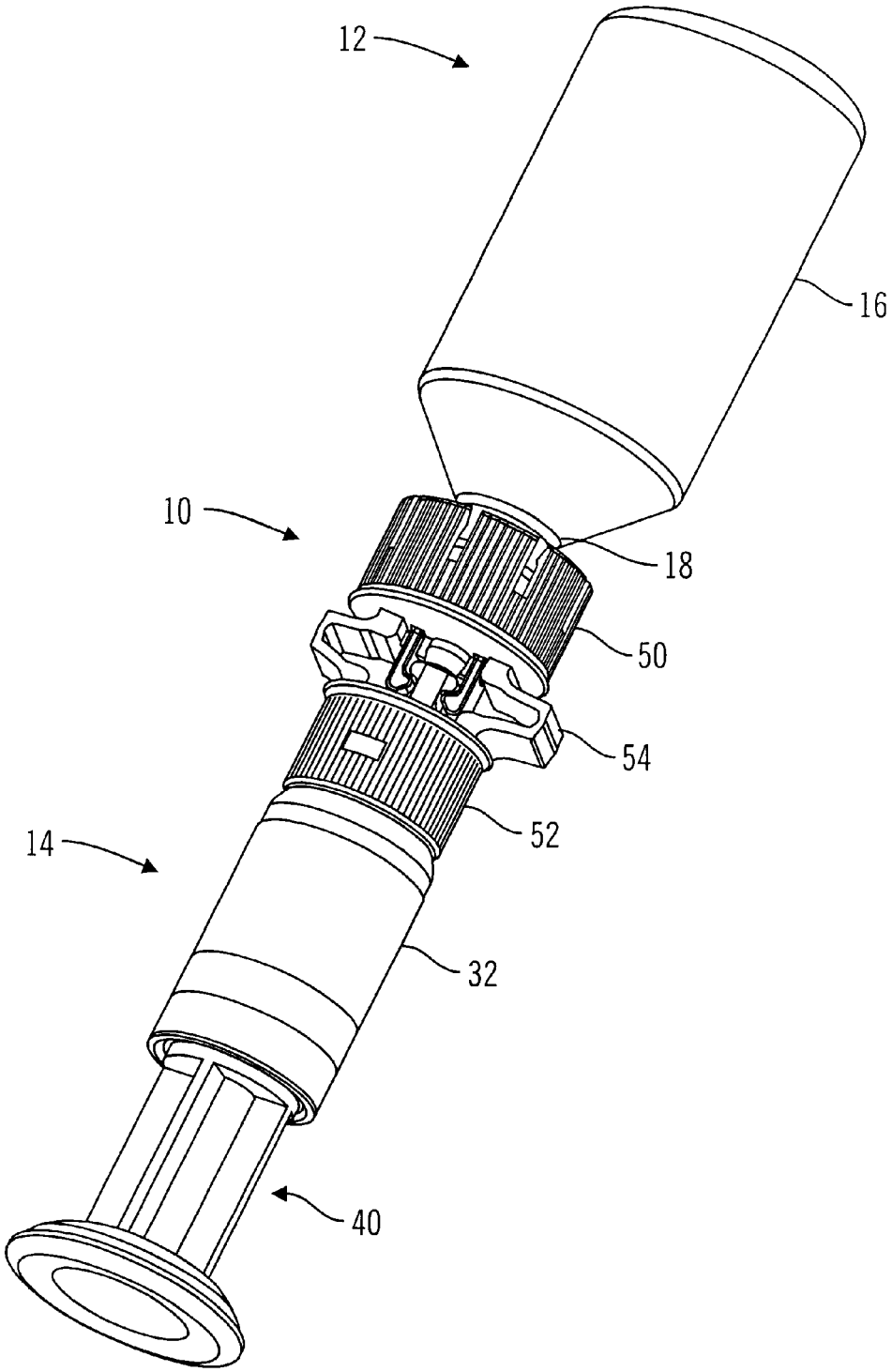
FIG. 3 is a perspective view of the system including the reservoir, the transfer guard and the vial assembled together with the transfer guard in a compressed position.
Figure 4:
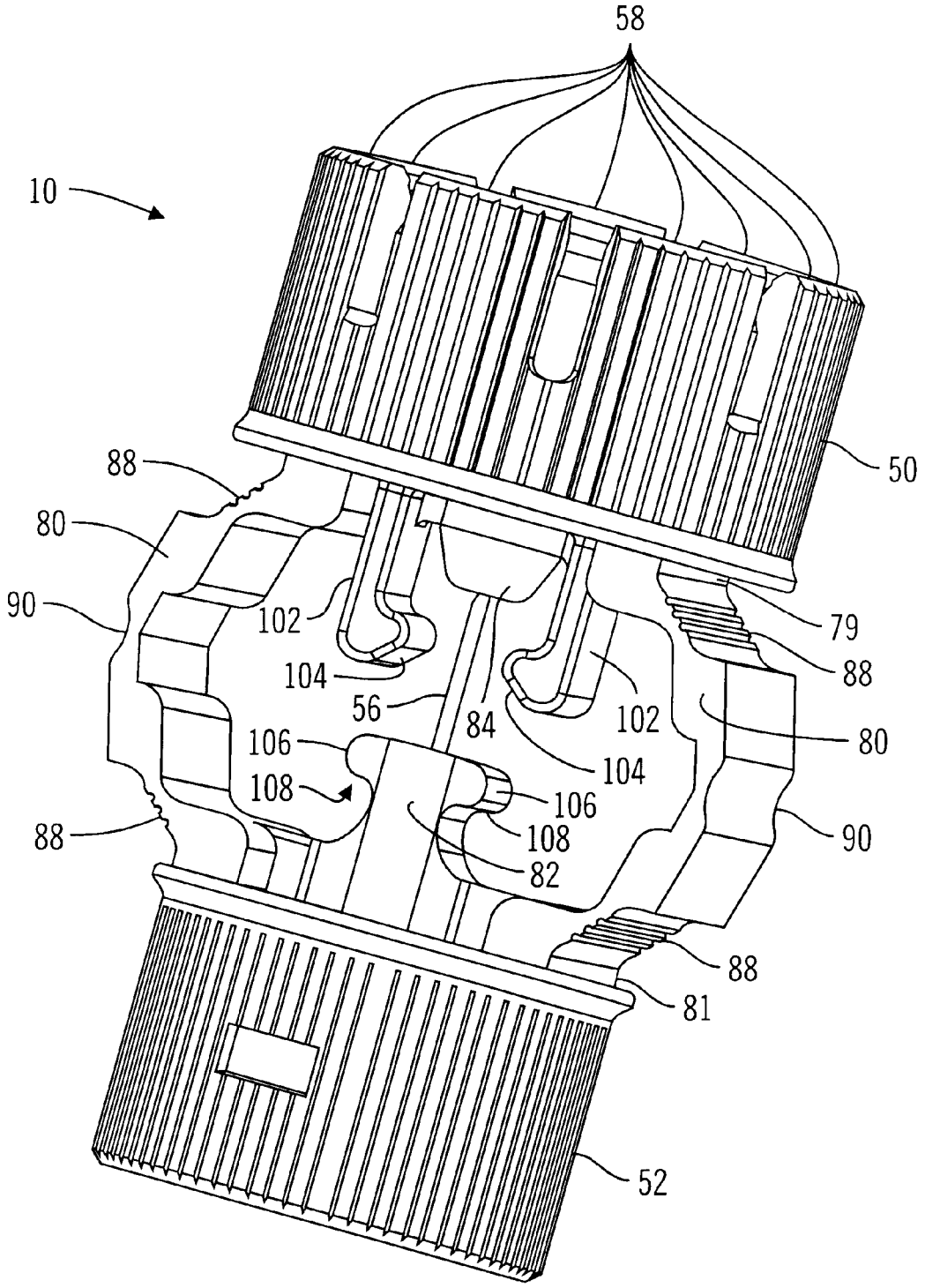
FIG. 4 is a perspective view of a transfer guard in an expanded position according to an embodiment of the present invention.

As shown in FIGS. 1–3, a transfer guard 10 is used as a part of a transfer system that includes a vial 12 and a reservoir 14. The vial 12 includes a vial body 16, a vial neck 18, an annular vial lip 20, a vial septum 22 and an annular vial collar 24. The vial body 16 contains fluid, such as medication or the like. The vial neck 18 connects the vial body 16 with the vial lip 20. Preferably, the vial lip 20 extends beyond an outer diameter of the vial neck 18. The vial lip 20 forms an opening 26 through the vial neck 18. The opening 26 is covered by the vial septum 22, which is held in place with the vial collar 24 that wraps around the sides of the vial septum 22 and the vial lip 20. The vial septum 22 seals the vial contents from the external environment and can be penetrated by a needle or the like. In preferred embodiments, the vial septum 22 is rubber or other elastomeric material that reseals after the removal of a needle. In alternative embodiments, the septum may have one or more pre-slit parts installed under compression. In preferred embodiments, the vial body 16, vial neck 18, and vial lip 20 are glass, but other embodiments may be formed from plastic, or metal, or the like. In preferred embodiments, the vial collar 24 is a malleable metal such as aluminum, but alternative embodiments may be formed from other materials such as other metals, plastic, composites, or the like.

In preferred embodiments, the reservoir 14 has a tubular reservoir body 32, a reservoir neck 34, a reservoir septum 36, a reservoir connector 38, and a plunger 40. One end 28 of the reservoir body 32 is entirely open to accept the plunger 40, and the other end 30 is attached to the reservoir neck 34. The reservoir neck 34 forms an opening 42 that is covered by the reservoir septum 36. The reservoir connector 38 surrounds the neck end 30 of the reservoir leaving an opening 42 for a needle to access the reservoir septum 36. The reservoir connector 38 is disclosed in U.S. patent application Ser. No. 09/428,818, filed Nov. 1, 1999 and entitled "Reservoir connector", which is hereby incorporated by reference. The inserted end 41 of the plunger 40 forms a seal with the internal diameter of the reservoir body 32. In preferred embodiments, each of the components of the reservoir 14 are formed from injection molded plastic, with the exception of the reservoir septum 36 and portions of the plunger 40, which are formed from rubber or other elastomeric material that reseals after the removal of a needle. In alternative embodiments, the reservoir body 32, reservoir neck 34, and reservoir connector 38 maybe made of glass, or metal, or the like.

Also, the reservoir may have an annular lip at the end of a neck and a collar used to hold a septum in place over the annular lip such as described above for the vial 12. Additional embodiments of the reservoir may have non-round, cross-sections such as square, polygonal, oval, or the like. In other embodiments, the reservoir connector is not needed and the transfer guard connects directly to the reservoir collar or reservoir lip. In preferred embodiments the reservoir connector 38 is male, but in alternative embodiments the reservoir connector is female.

As shown in FIGS. 1–10, the transfer guard 10 has a vial adapter 50, a reservoir adapter 52, a support structure 54, and a filling needle 56. In preferred embodiments, the transfer guard 10 is an injection molded plastic part assembled with a stainless steel filling needle 56. However, in alternative embodiments, the transfer guard 10 may be machined from metal or assembled from pieces formed from the same or different materials.

The vial adapter 50 is configured to mate with the vial collar 24. As shown in FIGS. 1–10, the vial adapter 50 has eight lock tabs 58 with grippers 62 at the end of each lock tab 58. The grippers 62 fit over the vial collar 24 and hold onto the underside of the vial lip 20 and/or the vial collar 24. In alternative embodiments, a larger or smaller number of lock tabs 58 or grippers 62 may be used, with the number being dependent on the size and shape of the vial 12 and the reusability of the transfer guard 10.

In further alternative embodiments, the vial adapter 50 may mate with other parts of the vial, such as the vial neck 18, vial body 16, or the like. As shown, the grippers 62 have a sloped leading edge 64 that helps the lock tabs 58 to expand and slide around the vial collar 24. In alternative embodiments, the leading edge 64 of the grippers 62 could be rounded or the like. The bottom edges 68 of the grippers 62 closer to the base 66 of the vial adapter 50 are also rounded so that the vial 12 can be extracted from the vial adapter 50 of the transfer guard 10. The rounded bottom edge 68 of the grippers 62 helps the lock tabs 58 to expand around the vial collar 24 as the vial 12 is disengaged from the vial adapter 50 of the transfer guard 10. In alternative embodiments, the bottom edge of the grippers 62 could be slopped or squared off depending on the shape of the vial 12 and whether there is a need to remove the vial 12 from the transfer guard 10 after use. Slots 70 between each lock tab 58 allow the lock tabs 58 to spread outward as the vial 12 is pushed or pulled past the grippers 62. In alternative embodiments, the slots 70 may be omitted and the vial adapter 50 is formed from a material that deforms or expands to slide over the vial collar 24. The length of the lock tabs 58, measured from a base 66 of the vial adapter 50 to the bottom edge 68 of the grippers 62, is slightly longer than the thickness of the side of the vial collar 24. Thus, when the vial 12 is fully installed into the vial adapter 50 of the transfer guard 10, it rests flat against the base 66 of the vial adapter 50 and the grippers 62 and the lock tabs 58 on the vial adapter 50, generally move back into their initial position prior to installation of the vial 12. The grippers 62 remain in contact with the vial lip 20 and/or the vial collar 24 to keep the vial 12 attached to the transfer guard 10.

Figure 11:
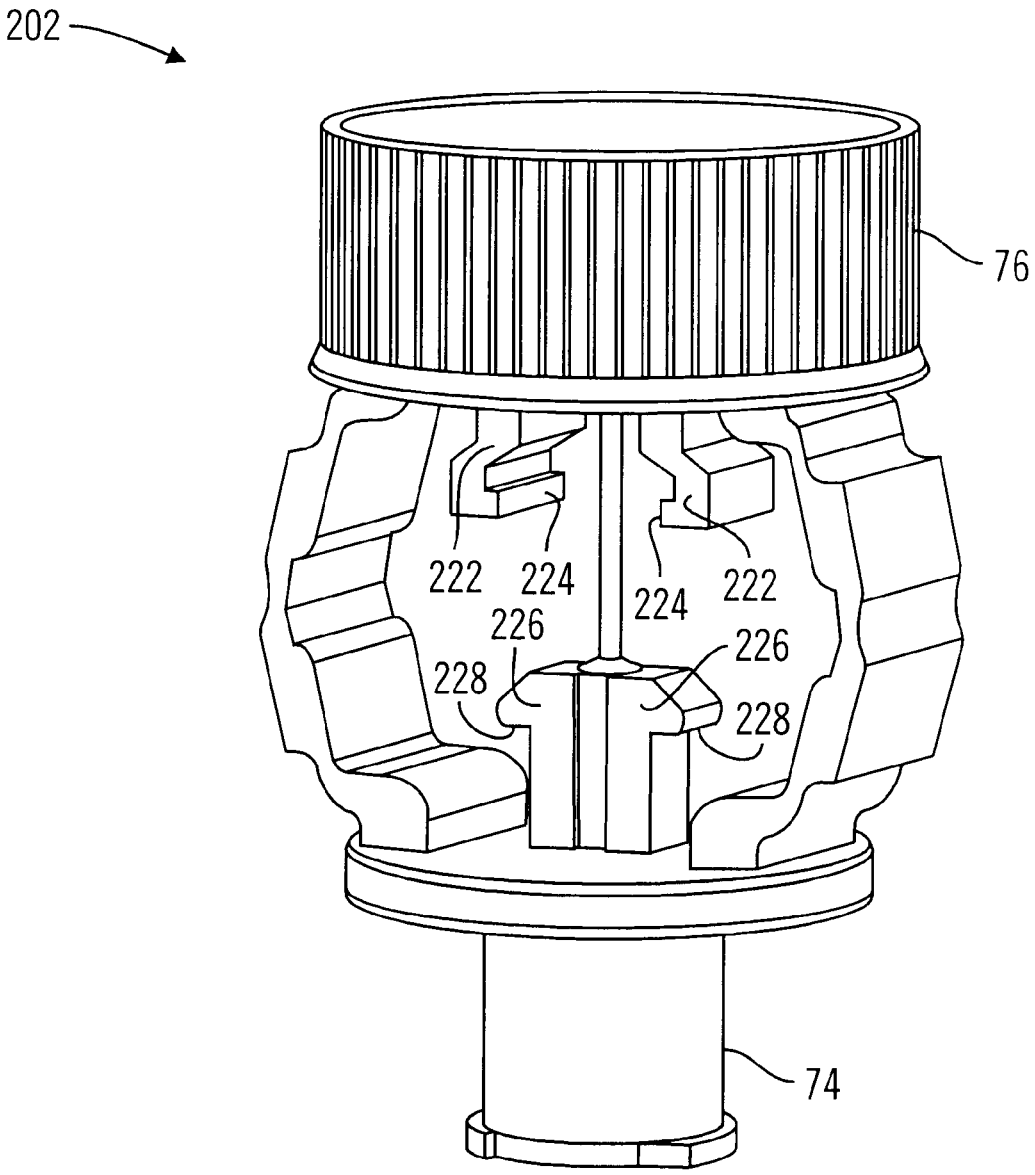
FIG. 11 is a perspective view of a transfer guard in the expanded position according to a second embodiment of the present invention.
Figure 15:
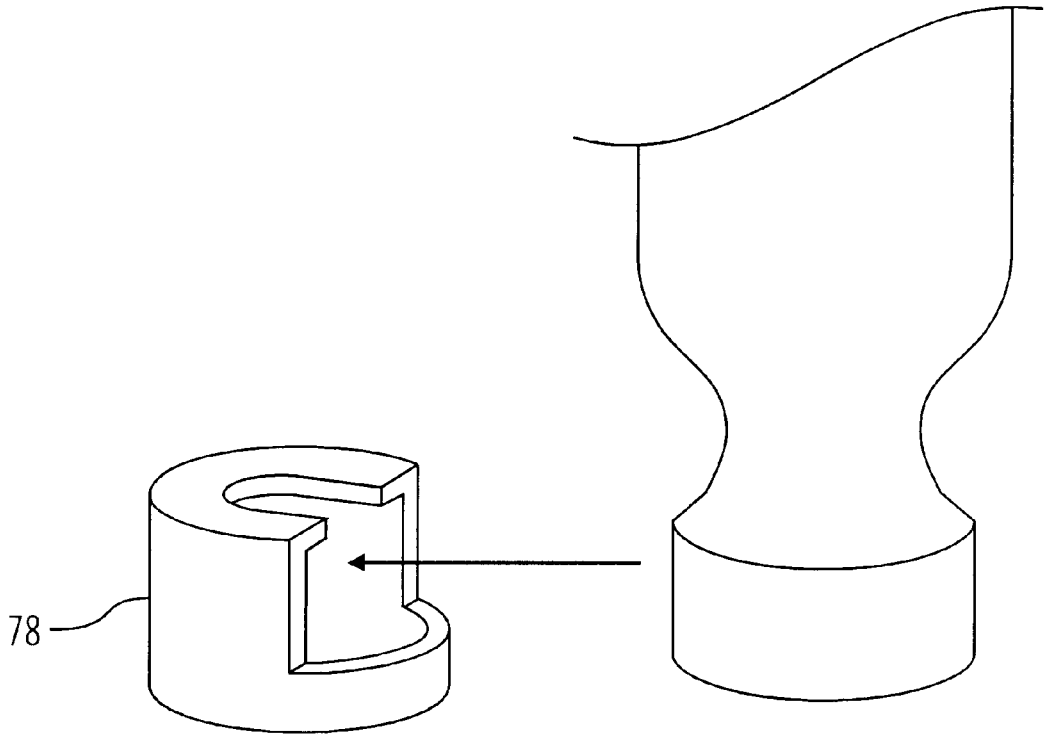
FIG. 15 is a perspective view of a side slide connector for use with a transfer guard according to an alternative embodiment of the present invention.

In another embodiment, a connector similar to that disclosed in U.S. patent application Ser. No. 09/428,818, filed Nov. 1, 1999 and entitled "Reservoir connector", which is hereby incorporated by reference, is used to hold the vial 12. For instance, a male connector is placed around the vial collar 24, and a vial adapter on the transfer guard is the female connector. In another embodiment, the connector on the vial is female, and the vial adapter on the transfer guard is male. In still other embodiments, the vial adapter on the transfer guard is a slip-on friction fit type connector 76 to slide over the vial collar 24, or a Luer connector 74 such as shown in FIG. 11, or a female Luer connector (not shown) to connect to a corresponding Luer connector on the vial, or a side slotted type connector 78 as shown in FIG. 15 to slide over the vial collar 24.

Figure 10:
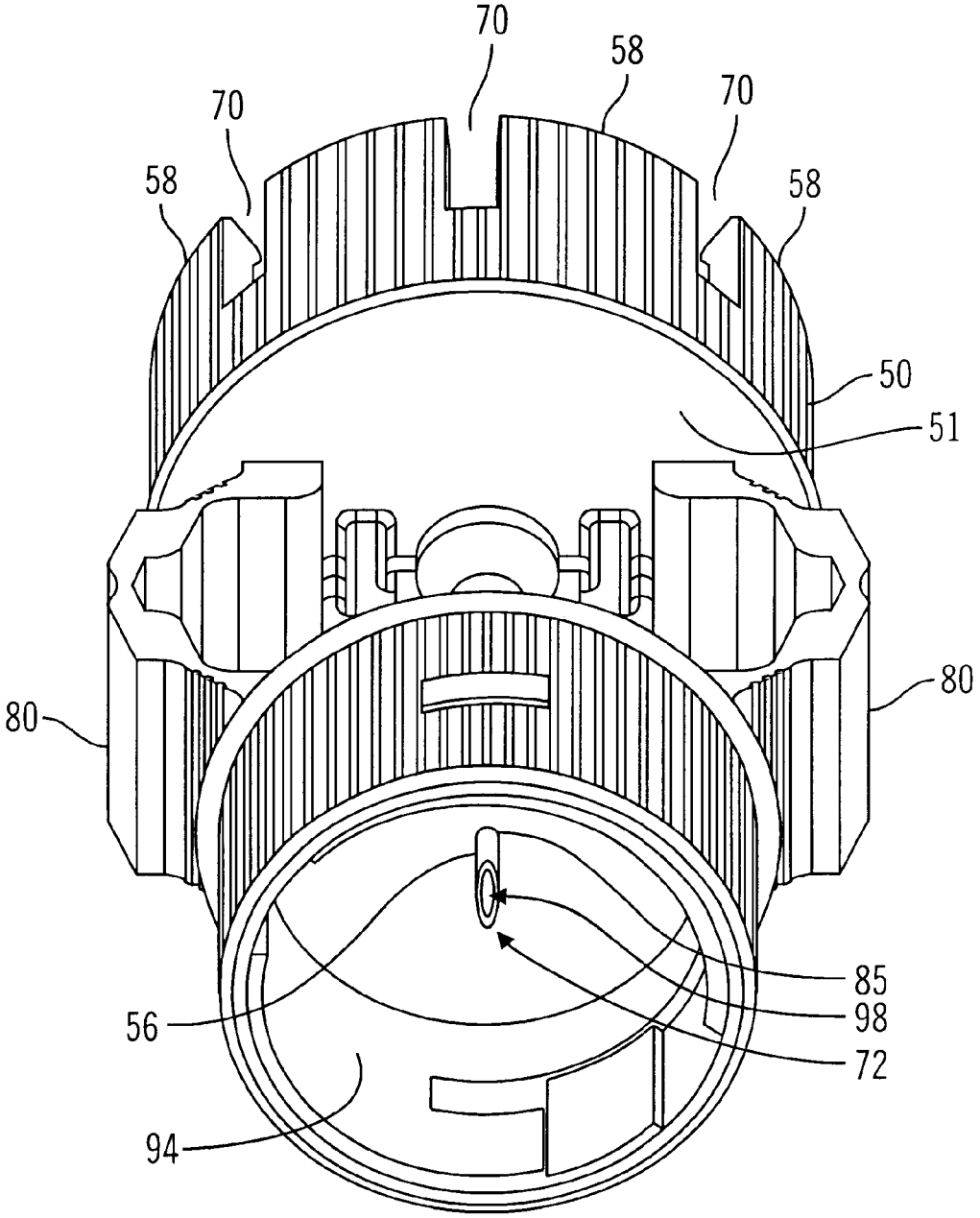
FIG. 10 is a perspective view from the reservoir connector end of the transfer guard of FIG. 4 in the expanded position.

The reservoir adapter 52 on the transfer guard 10 is configured to mate with the reservoir connector 38. In the preferred embodiment, as shown in FIG. 10, the reservoir adapter 52 is a female connector similar to that disclosed in U.S. patent application Ser. No. 09/428,818, filed Nov. 1, 1999 and entitled "Reservoir connector". The male portion of the connector 38 is included as part of the reservoir 14. The connectors snap together when one connector is slid into the other connector and twisted relative to the other connector; a snap indicates that the connectors are fully engaged and that a reservoir needle tip 72 has passed through the reservoir septum 36. In alternative embodiments, the reservoir adapter could be a Luer style connector 74 such as shown in FIG. 11 that connects with a corresponding Leur connector on the reservoir. Examples of other embodiments include a slotted snap-on connector such as the one used for the vial adapter 50 in FIGS. 1–10; a side slotted type connector 78 shown in FIG. 15, or a slip-on friction fit type connector 76 such as the one shown as the vial adapter in FIGS. 11–13, or the like. In still other embodiments, the sex-type of the reservoir adapter and the reservoir connector may be exchanged so that the male connector becomes female and visa versa.

Figure 5A:
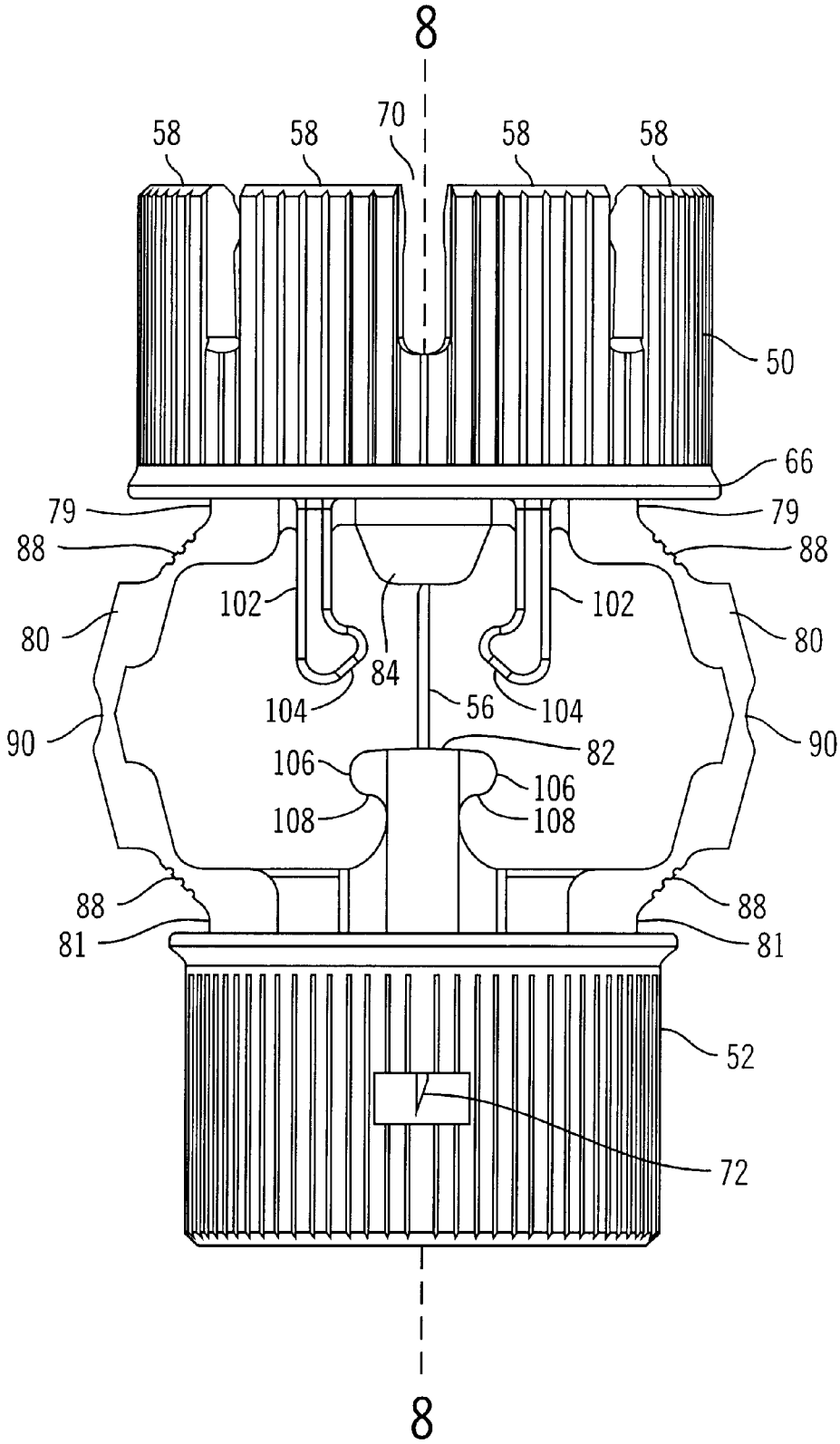
FIG. 5(*a*) is a front view of the transfer guard of FIG. 4 in the expanded position.
Figure 5B:
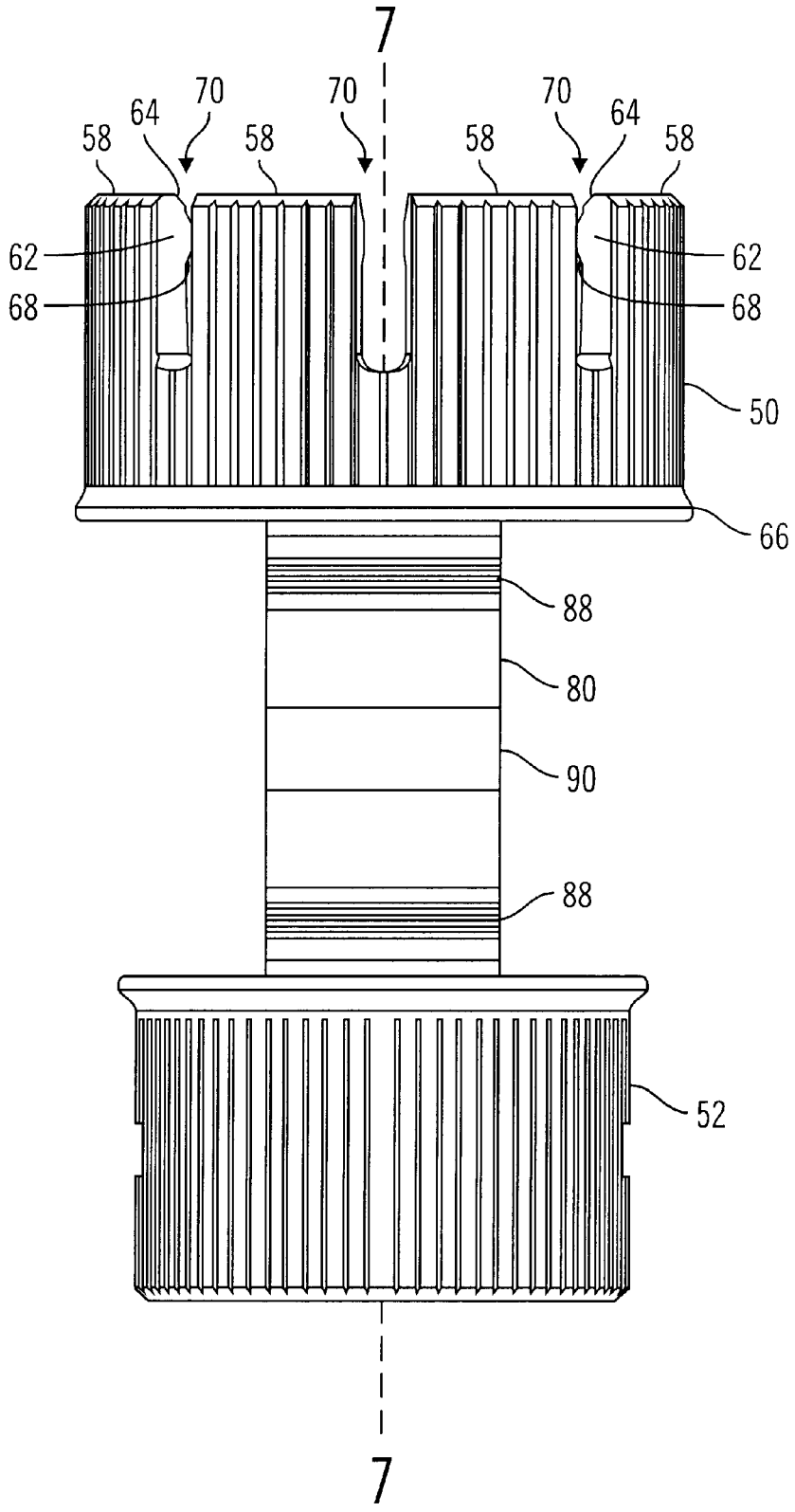
Figure 14:
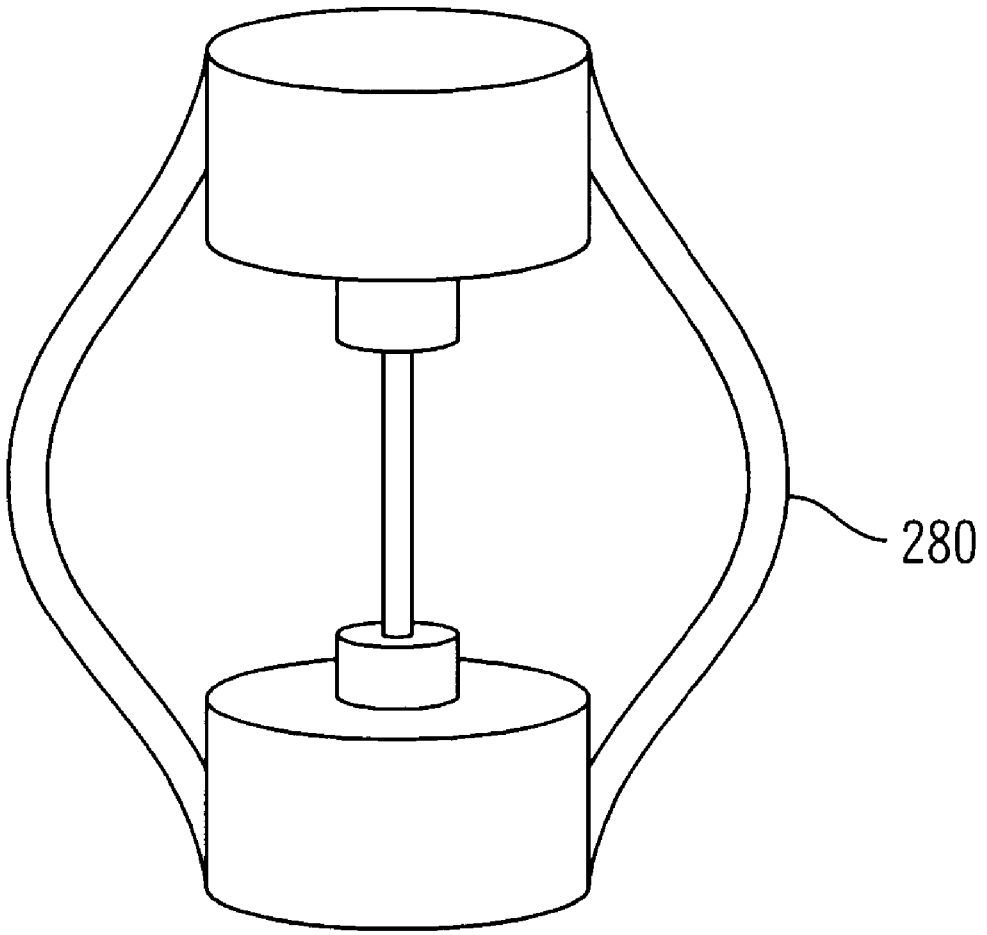
FIG. 14 is a perspective view of a transfer guard according to a fourth embodiment of the present invention.
Figure 17:
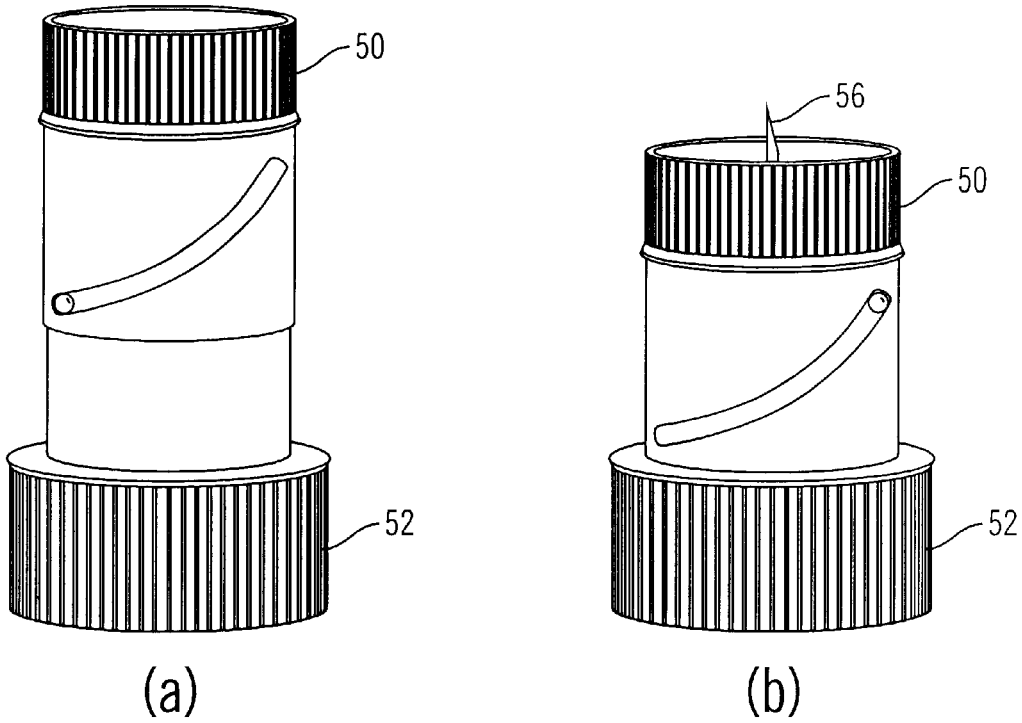
FIG. 17(*a*) is a perspective view of a transfer guard in an extended position according to a fifth embodiment of the present invention.
Figure 18:
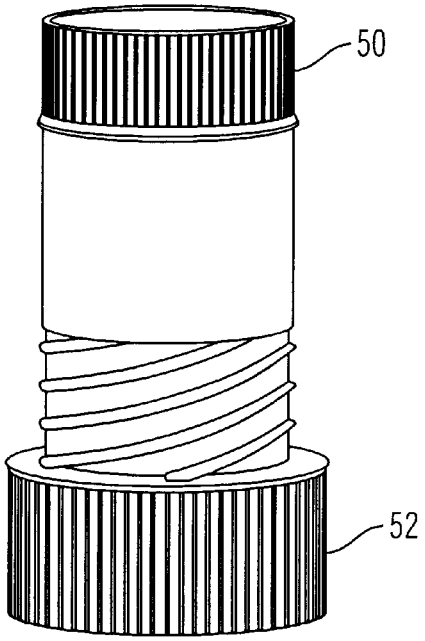
FIG. 18 is a perspective view of a transfer guard in an extended position according to a sixth embodiment of the present invention.

In preferred embodiments, the support structure 54 includes a pair of actuating arms 80, a needle mount 82, a needle guide 84, and a locking mechanism. One end 79 of each actuating arm 80 is attached to the vial adapter 50 and the other end 81 of each actuating arm 80 is attached to the reservoir adapter 52. The actuating arms 80 align the radial center of the vial adapter 50 with the center 85 of the reservoir adapter 52. The actuating arms 80 include hinges 88 and 90 that permit folding of the actuating arms 80. As shown in FIGS. 5(*a*) and 6, the actuating arms 80 have 3 hinges 88 and 90; the center hinges 90 fold inward toward the center of the transfer guard 10, and the remaining hinges 88 fold outward away from the transfer guard 10. As the actuating arms 80 fold, the transfer guard 10 moves from an extended position (see FIG. 5(*a*)) to a compressed position (see FIG. 6) bringing the vial adapter 50 closer to the reservoir adapter 52. In alternative embodiments, more or less actuating arms 80 may be used and the actuating arms 80 may have a greater number or a smaller number of hinges depending on the size of the vial 12, size of the reservoir 14, the desired structural stiffness of the transfer guard 10, or the like. Also the folding directions of the hinges 88 and 90 may be interchanged or even all the same direction. In other alternative embodiments, the actuating arms may be flexible bands 280 that bend to move the vial 12 closer to the reservoir 14 such as shown in FIG. 14. In still other embodiments, the actuating arms 80, may be replaced by foam that may be compressed or two piece configurations (shown in FIGS. 17 and 18) that slide or twist together to bring the vial 12 closer to the reservoir 14.

The needle mount 82 is an extension of the reservoir adapter 52, which holds the filling needle 56 longitudinally aligned with the axial centerline (shown as line 8—8 in FIG. 5(*a*) and line 7—7 in FIG. 5(*b*)) of the transfer guard 10 and also substantially prevents the filling needle 56 from moving with respect to the reservoir adapter 52. Alternatively, different longitudinal alignments may be used to position the needle at a different location relative to the axial centerline. In preferred embodiments, the needle mount 82 is formed as an integral part of the injection molded transfer guard 10, as shown in FIG. 1–10. Preferably, the needle mount 82 is molded in a position, radially centered on a back side 53 of the reservoir adapter 52, extending away from the reservoir 14. In other embodiments, the needle mount 82 is part of the vial adapter 50 rather than the reservoir adapter 52.

During assembly of the transfer guard 10, the filling needle 56 is inserted generally into the center of the needle mount 82 and is held in place by friction. Alternatively, the filling needle 56 may be held in place by adhesives, detents, flutes, flanges, or the like. The depth that the filling needle 56 is inserted through the needle mount 82 is set so that the reservoir needle tip 72 of the filling needle 56 extends far enough into the reservoir adapter 52 to penetrate through the reservoir septum 36 when the reservoir 14 is fully engaged with the reservoir adapter 52. In addition, the filling needle 56 depth is set so that the reservoir needle tip 72 terminates shallow enough within the reservoir adapter 52 that it does not extend past a protective side wall 94 of the reservoir adapter 52. Thus, the side wall 94 of the reservoir adapter 52 generally protects the reservoir needle tip 72 from contact with the user. In preferred embodiments, the filling needle 56 is made of stainless steel, and has a bore 98 through a longitudinal axis creating a lumen for fluid transfer. In other embodiments, the filling needle 56 may be composed of plastic, ceramic, metals, or the like so long as the filling needle 56 has sufficient strength to pierce the vial septum 22 and the reservoir septum 36, and has enough wall integrity to withstand the inward pressure from the vial septum 22 and the reservoir septum 36 pushing in from the sides. In still other embodiments, the filling needle 56 may be of a non-coring design, having a solid tip with one or more fluid path lumens that have a at least one port through the side wall of the filling needle.

Preferably, as shown in FIGS. 1–10, the needle guide 84 is formed as an extension of the vial adapter 50 that protects a vial needle tip 96 of the filling needle 56 from contact with the user. The needle guide 84 also guides the vial needle tip 96 through the vial adapter 50 when the transfer guard 10 is compressed. In preferred embodiments, the needle guide 84 is radially centered on a back side 51 of the vial adapter 50 and extends away from the vial adapter 50 toward the reservoir adapter 52. A bore 100 passes through the axial center of both the needle guide 84 and the vial adapter 50. The bore 100 has a diameter slightly larger than the outer diameter of the filling needle 56 so that the filling needle 56 can slide through the bore 100 without substantial resistance. Alternative embodiments may be off-centered to permit penetrating different portions of the vial septum 22.

The length of the needle guide 84 is selected so that when the transfer guard 10 is in the extended position, the vial needle tip 96 is located inside the bore 100 of the needle guide 84. However, the length of the needle guide 84 is selected so that when the transfer guard 10 is in the compressed position, the vial needle tip 96 extends into the vial adapter 50 to sufficiently penetrate the vial septum 22 to provide fluid communication. Thus, when the transfer guard 10 is extended, the filling needle 56 extends from the reservoir side of the reservoir adapter 52, through the reservoir adapter 52, past the support structure 54, and into the bore 100 of the needle guide 84. When the transfer guard 10 is compressed, the filling needle 56 further extends past the base 66 of the vial adapter 50 to establish fluid contact between the vial 12 and the reservoir 14.

Figure 6:
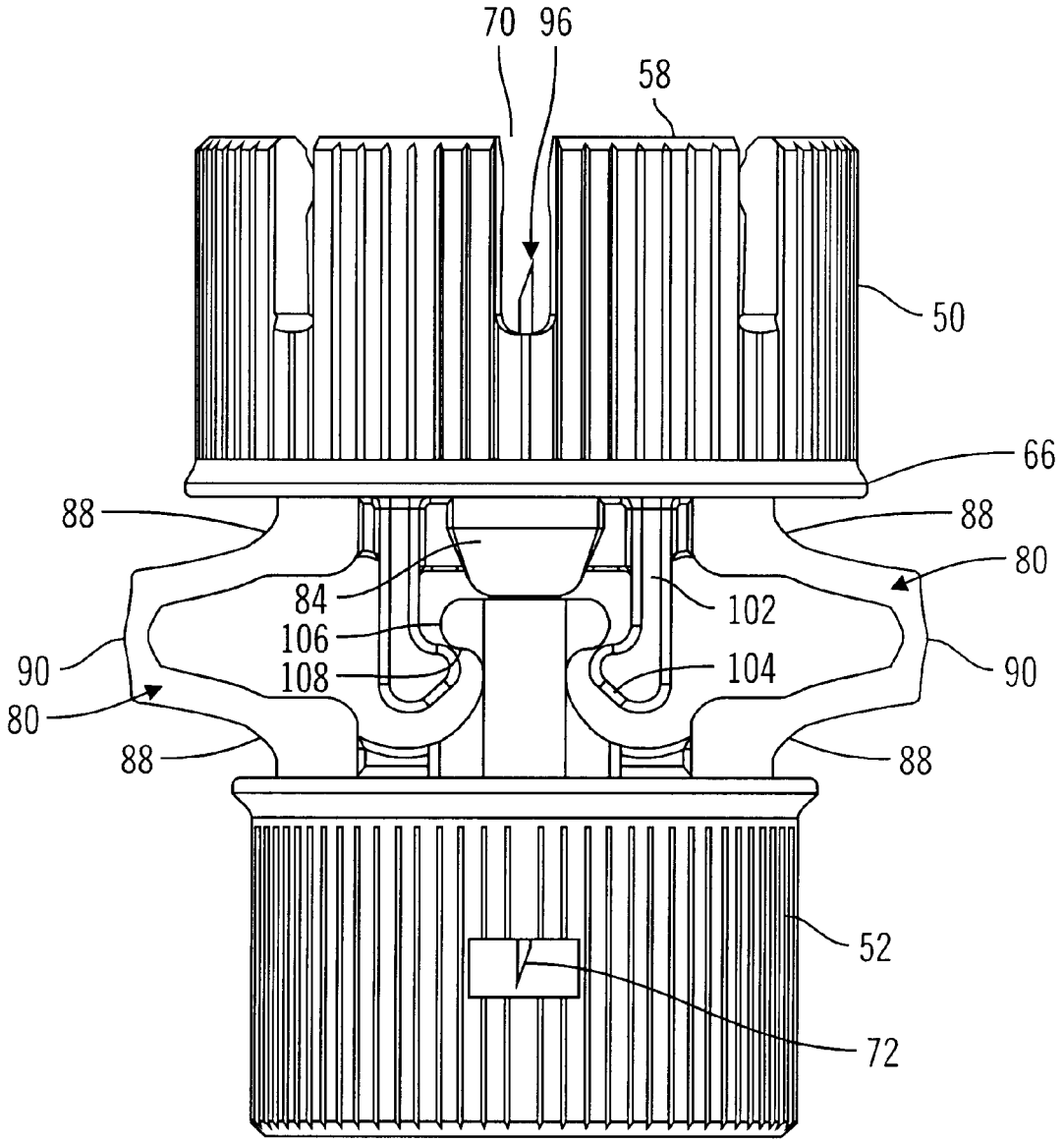
FIG. 6 is a front view of the transfer guard of FIG. 4 in the collapsed position.
Figure 7:
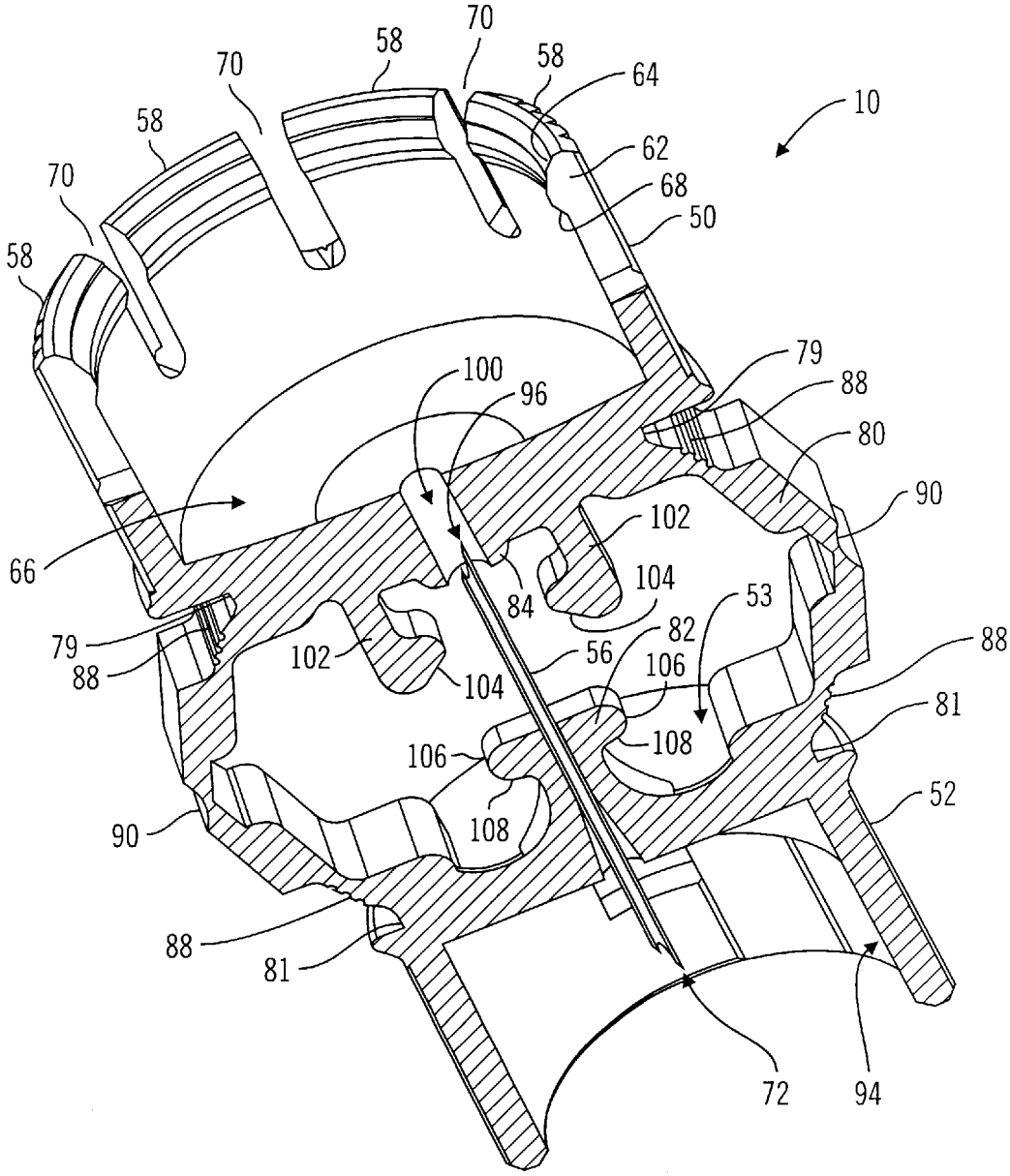
FIG. 7 is a cross-sectional front view of the transfer guard in the expanded position as shown along the line 7—7 in FIG. 5(*b*).
Figure 8:
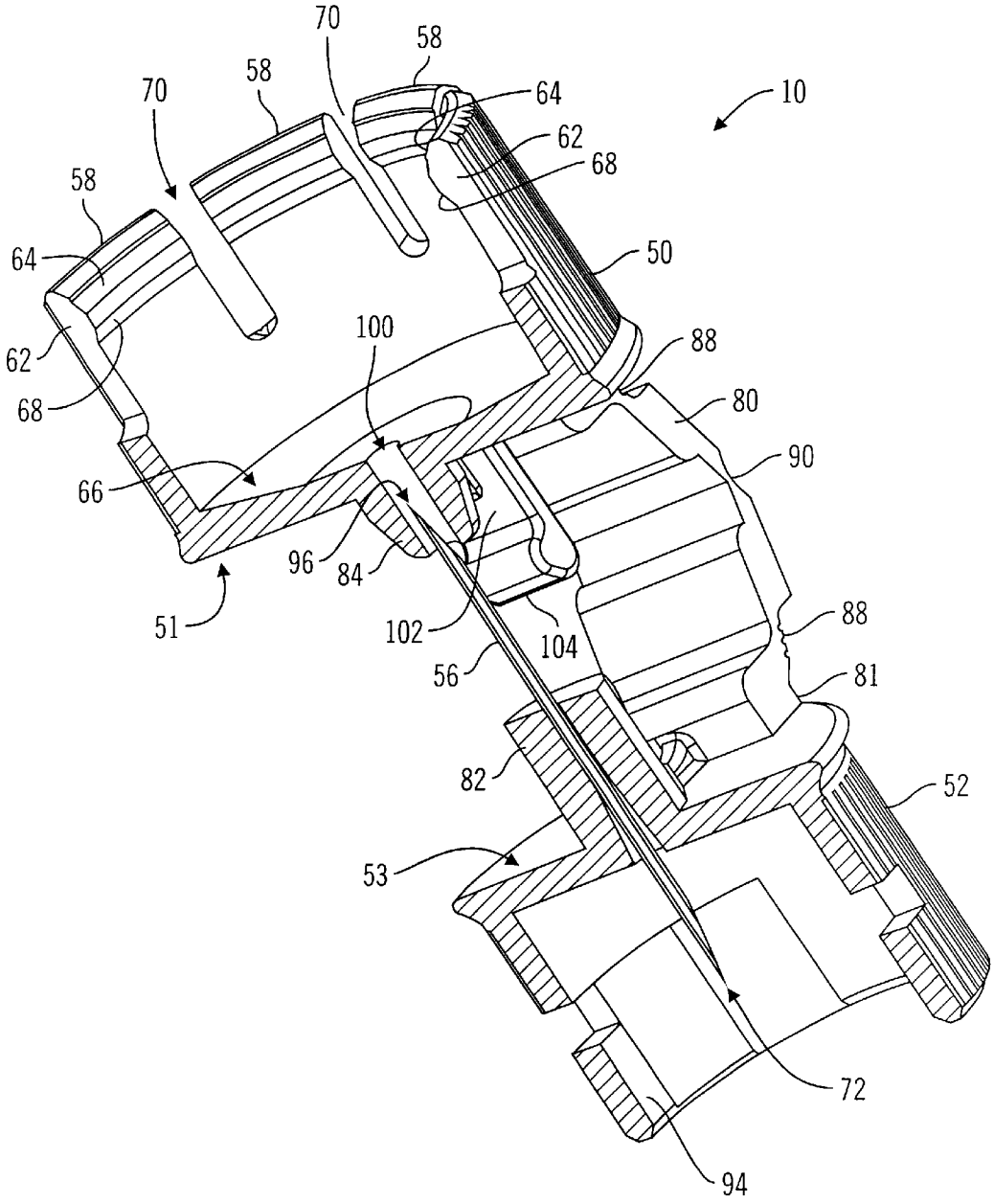
FIG. 8 is a cross-sectional side view of the transfer guard in the expanded position as shown along the line 8—8 in FIG. 5(*a*).
Figure 9:
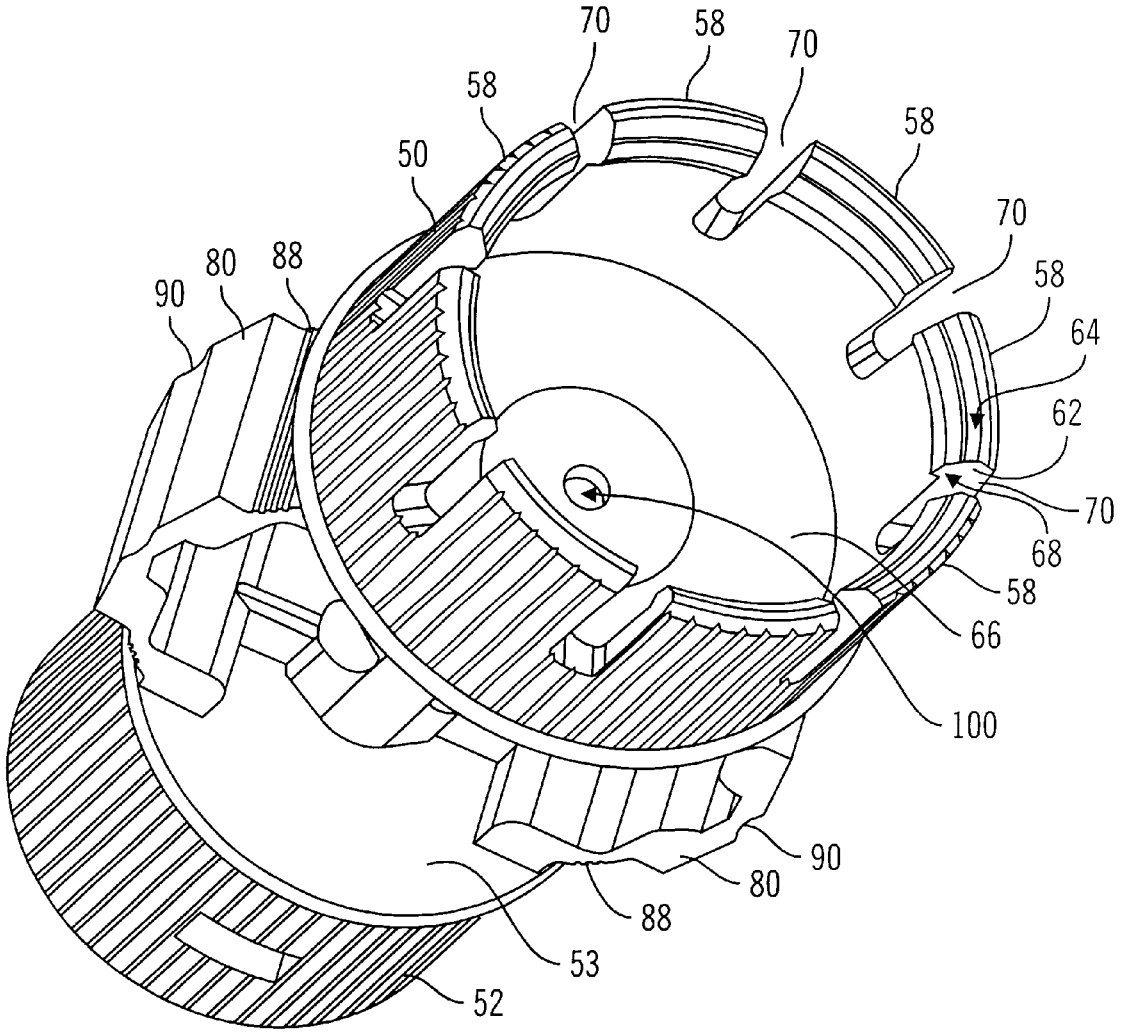
FIG. 9 is a perspective view from the vial connector end of the transfer guard of FIG. 4 in the expanded position.

In preferred embodiments, the locking mechanism includes a pair of locking arms 102, each with a hooked end 104, and a locking knob 106 to hold and lock the transfer guard 10 in a compressed position. The locking arms 102 extend from the back side 51 of the vial adapter 50 toward the reservoir 14 as shown in FIG. 1-10. The end of the needle mount 82 expands to form the locking knob 106 that mates with the hooked ends 104 of the locking arms 102. Preferably, the hooked ends 104 are rounded and the inside edges are sloped so that as the hooked ends 104 contact the locking knob 106, the hooked ends 104 slide around the locking knob 106 and bend the locking arms 102 away from the filling needle 56. Once the hooked ends 104 slide past the locking knob 106, the locking arms 102 generally move back into their initial orientation, and the hooked ends 104 latch under the locking knob 106, as shown in FIG. 6. The rounded underside 108 of the locking knob 106 and the rounded hooked ends 104 allow the transfer guard 10 to be unlocked by pulling the vial 12 away from the reservoir 14 after filling the reservoir 14. In alternative embodiments, such as transfer guards 202 and 210 shown in FIGS. 11 and 12 respectively, the locking arms 222 have squared off hooked ends 224 and the locking knob 226 has squared edges 228 that resist unlocking when the user tries to pull the vial 12 away from the reservoir 14. In further alternative embodiments, more or less locking arms may be used depending on the size of the vial 12, size of the reservoir 14 and the strength of the structural support. In still other embodiments, the locking arms are part of the reservoir adapter 52, while the locking knob is part of the vial adapter 50. In other alternative embodiments, other locking mechanisms are used or no locking mechanism is needed and is thus omitted.

In use, a user installs the transfer guard 10 to facilitate safer filling of a reservoir 14. As shown in FIGS. 1 and 2, the first step involves connecting an empty reservoir 14 to the transfer guard 10 by pushing the reservoir connector 38 into the reservoir adapter 52 and twisting until they snap together. When the reservoir connector 38 is mated to the reservoir adapter 52, the reservoir needle tip 72 passes through the reservoir septum 36 and communicates with the inner volume of the reservoir 14. The next step involves connecting the vial 12 to the transfer guard 10 by sliding the vial collar 24 into the vial adapter 50 until the grippers 62 at the tips of the lock tabs 58 snap in place around the vial collar 24 near the vial neck 18. The plunger 40 depth is then adjusted inside the reservoir 14 such that the volume of air trapped inside the reservoir 14 approximately equals the volume of medication that will be drawn into the reservoir 14. Next, as shown in FIGS. 2 and 3, the transfer guard 10 is compressed until the vial needle tip 96 is forced through the vial septum 22 for fluid communication with the medication in the vial 12, and the locking arms 102 slide into position around the locking knob 106 for holding and locking the transfer guard 10 in the compressed position. While holding the assembly generally upside down so that the medication covers the vial needle tip 96, the plunger 40 is pushed into the reservoir 14 to force the air from the reservoir 14 through the filling needle 56 into the vial 12. The plunger 40 is then pulled back to draw the desired amount of medication from the vial 12 through the filling needle 56 into the reservoir 14.

In alternative embodiments, the operational steps may be performed in a different order. For example, but without limitation, the plunger 40 may be pulled back to fill the reservoir 14 with air prior to attaching the reservoir 14 to the transfer guard 10, or the vial 12 may be attached to the transfer guard 10 prior to attaching the reservoir 14.

After filling the reservoir 14, the user re-expands the transfer guard 10 to the extended position by holding onto the vial 12 and the reservoir 14, and pulling them apart until the locking arms 102 unlock from the locking knob 106. Alternatively, the user may re-expand the transfer guard 10 by using a finger and a thumb to applying pressure to the central hinges 90 on the actuating arms 80, squeezing the actuating arms 80 toward the center of the transfer guard 10 until the locking arms 102 unlock from the locking knob 106. The actuating arms 80 are returned generally toward their original extended position so that the vial needle tip 96 is retracted from the vial 12 and is protected inside the bore 100 of the needle guide 84. Finally, the reservoir 14 is disconnected from the transfer guard 10 for use in an infusion pump, or the like. If the vial 12 is empty after filling the reservoir 14, the transfer guard 10 generally remains attached to the vial 12 and is discarded with the vial 12. If the vial 12 still contains medication, the transfer guard 10 is generally removed and discarded and, a new transfer guard 10 is used in the next filling operation. Alternatively, the transfer guard 10 may remain attached to the vial 12 for use in later filling operations. In other alternatives, the reservoir is removed without re-expanding the transfer guard.

Figure 12:
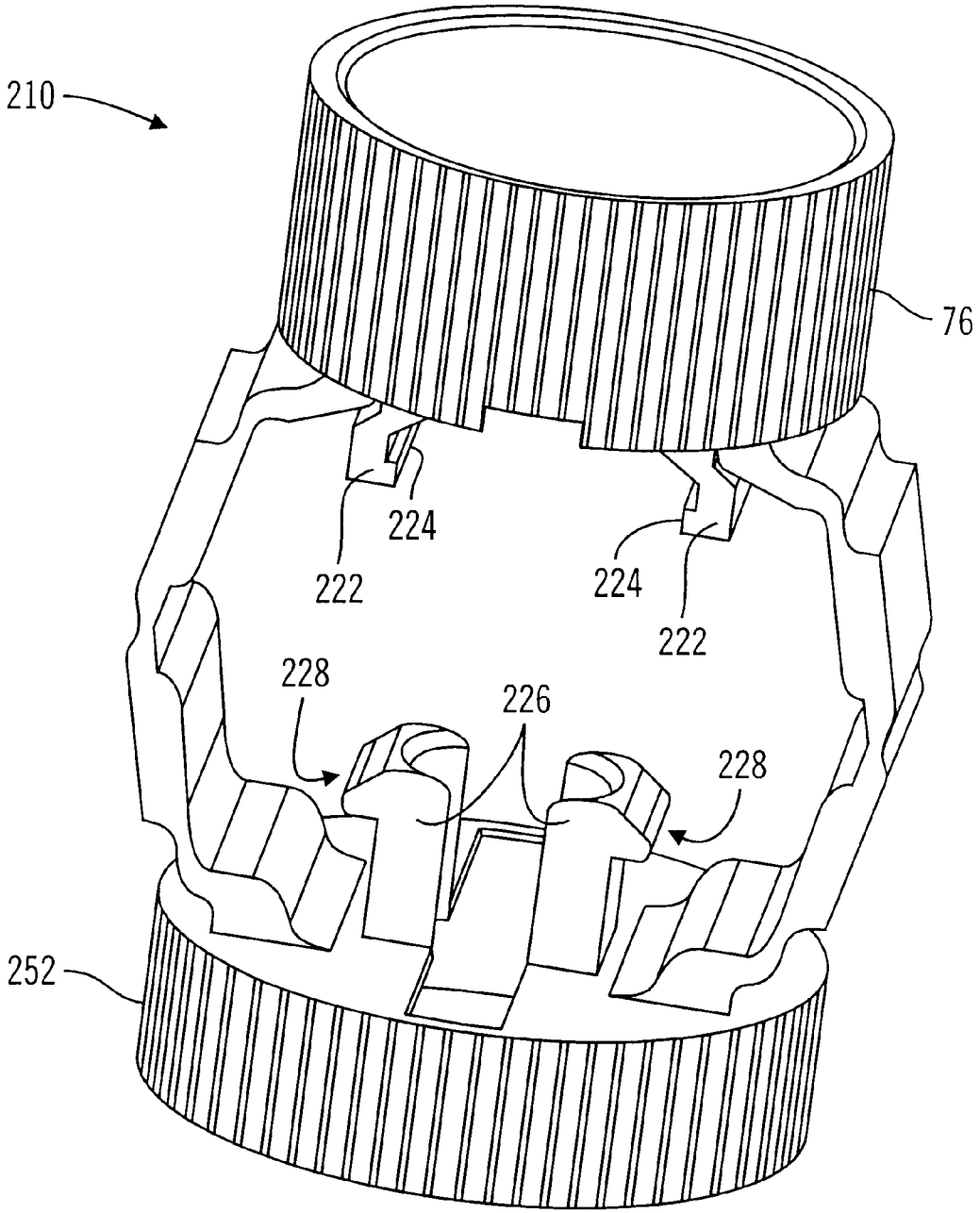
FIG. 12 is a perspective view of a transfer guard in the expanded position according to a third embodiment of the present invention.
Figure 13:
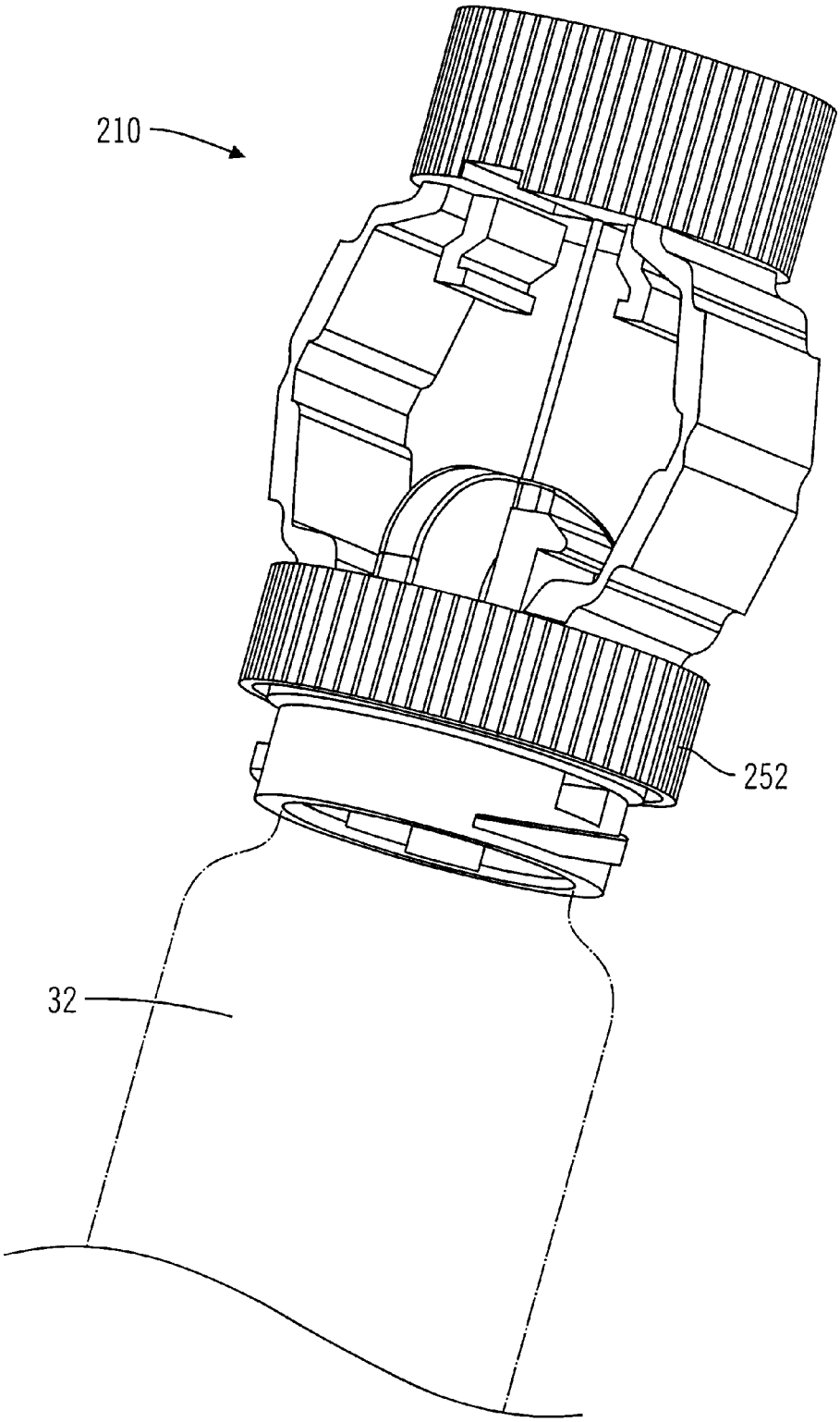
FIG. 13 is a perspective view of the transfer guard of FIG. 12 in the expanded position with a reservoir, reservoir connector and needle installed in the transfer guard.

In alternative embodiments, the filling needle 56 is not formed as an integral part of the transfer guard 10. Rather, the reservoir adapter of the transfer guard accepts reservoirs that included their own needle. FIGS. 12 and 13 show one embodiment of a transfer guard 210 with a reservoir adapter 252 that accepts a reservoir with a needle. In other embodiments, the transfer guard mates with a standard syringe and needle. Once the needle is installed into the transfer guard, the needle tip is protected within the needle guide or within the vial 12 until the needle is removed along with the syringe to administer the medication. Thus, the transfer guard generally protects the needle tip during the filling process.

Figure 16:
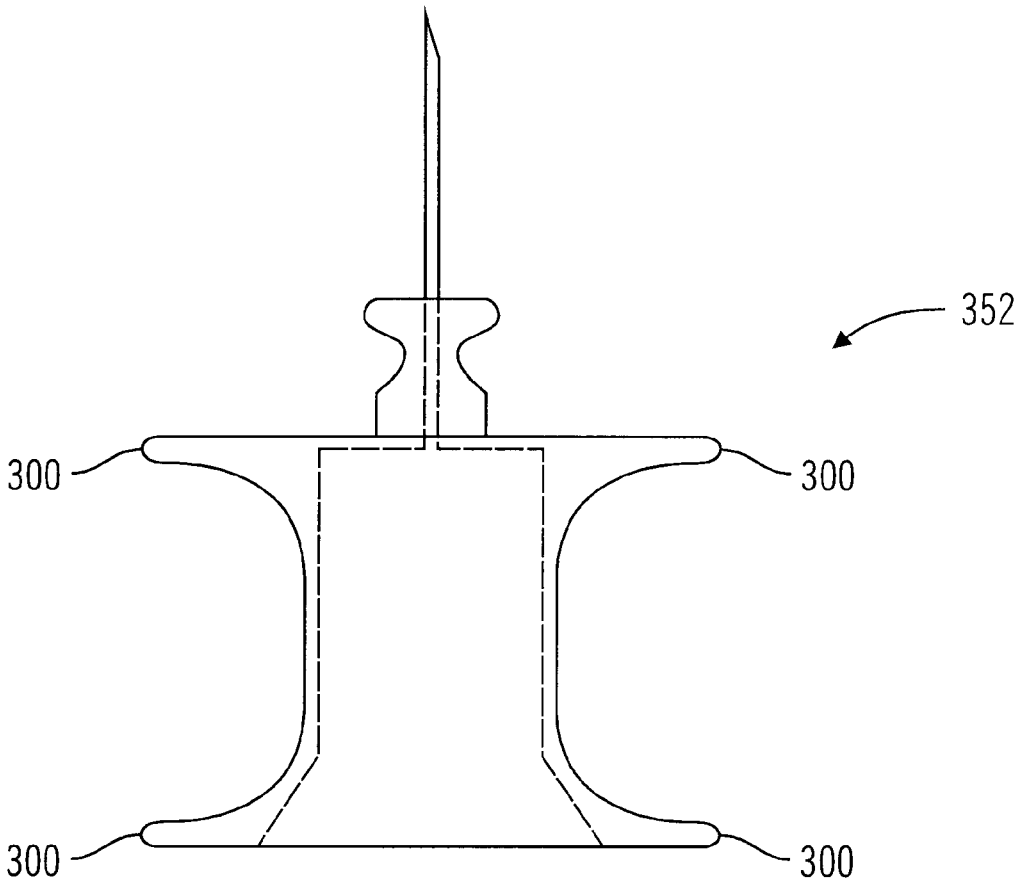
FIG. 16 is a side plan view of a connector for use with a transfer guard that includes lips extending around the outer diameter of a connector according to another alternative embodiment of the present invention.

In alternative embodiments, the vial adapter and the reservoir adapter may have one or more ridges encircling the external circumference of the adapter. An example of a reservoir adapter 352 with ridges 300 is shown in FIG. 16. The ridges 300 provide an additional grip to keep the user's fingers from slipping off of the adapter 352 when the user installs or removes containers, expands or compresses the transfer guard, or actuates the plunger 40 to fill the reservoir 14. In other embodiments, the ridges 300 serve as shields to further protect the user's fingers when connecting a transfer guard 210, such as shown in FIGS. 12 and 13, to a reservoir that has its own needle. The height and number of ridges is dependent on the types of containers that will be attached to the transfer guard, the force needed to compress or expand the transfer guard and the force needed to fill the reservoir 14.

Figure 19:
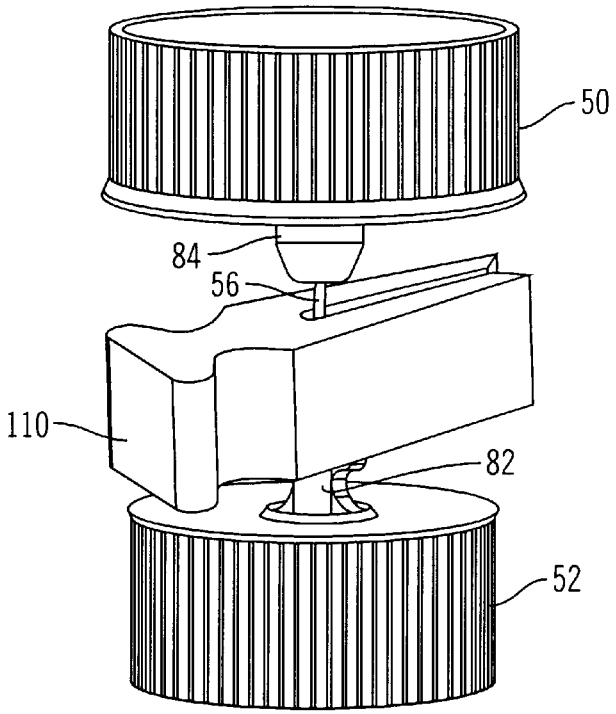
FIG. 19 is a perspective view of portions of a transfer guard with a compression prevention clip installed. The actuation arms and the locking mechanism are not shown in the drawing for clarity.
Figure 20:
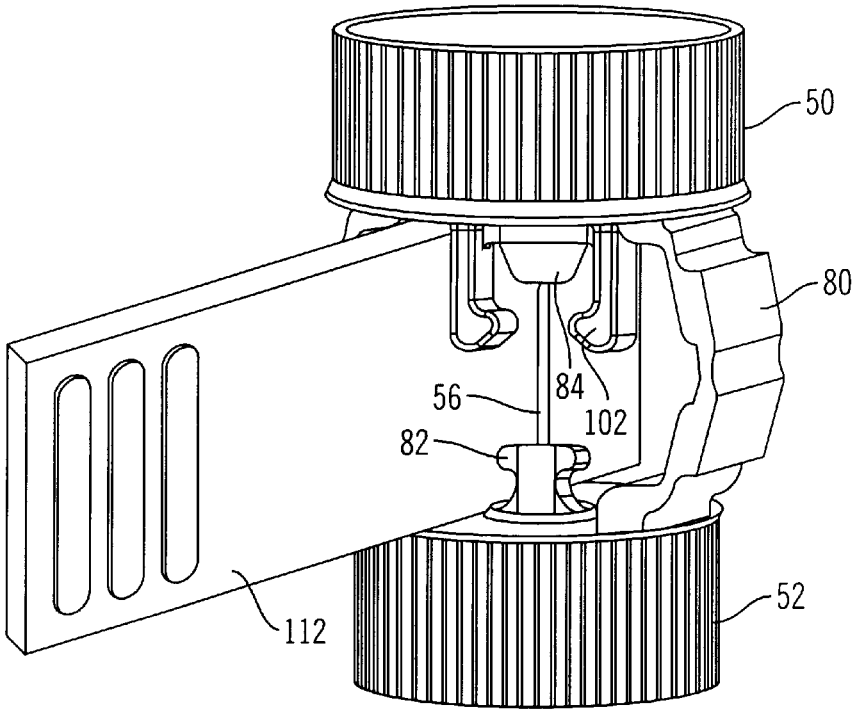
FIG. 20 is a perspective view of a transfer guard with a compression prevention tab installed.

To protect the user, some embodiments of the transfer guard 10 have a compression prevention mechanism that inhibits premature compression of the transfer guard 10. In one embodiment, shown in FIG. 19, a removable clip 110 is slid over the filling needle 56, between the vial adapter 50, the reservoir adapter 52, and inside the actuating arms 80 to prevent the transfer guard 10 from being compressed. The clip 110 must be removed before the transfer guard 10 can be compressed. In another embodiment, as shown in FIG. 20, a removable rigid tab 112 is slid between the vial adapter 50 and the reservoir adapter 52. The tab 112 must be removed before the transfer guard 10 can be compressed.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A transfer guard for use by an individual for transferring contents from a supply container to a receiver container that accepts the contents, the transfer guard comprising:

a supply adapter that is adapted to be mated with the supply container;

a receiver adapter that is adapted to be mated with the receiver container;

a support structure coupled between the supply adapter and the receiver adapter to support the supply adapter and the receiver adapter;

a locking mechanism engagable to substantially limit the supply adapter and receiver adapter from moving relative to each other; and a needle that passes through the supply adapter and the receiver adapter, wherein the needle is attached to one of the adapters for support, wherein the needle provides a passage for the contents to transfer from the supply container through both of the adapters into the receiver container, wherein the needle includes at least one point that is substantially protected by the adapters from contact with the individual, and wherein the at least one needle point is exposed to the air after the containers are mated with the adapters and before the transfer guard is compressed.

2. A transfer guard according to claim 1, wherein the support structure facilitates movement of the adapters from a first more distant position relative to each other second closer position relative to each other.

3. A transfer guard according to claim 2, wherein the transfer guard includes a locking mechanism that may be engaged to keep the adapters from moving from a first more distant position relative to each other to a second closer position relative to each other.

4. A transfer guard according to claim 1, wherein the support structure includes a foam member that is compressible to move the adapters in closer proximity to each other.

5. A transfer guard according to claim 1, wherein the support structure is comprised of at least two threaded parts that are screwed together to move one adapter in closer proximity to the other adapter.

6. A transfer guard according to claim 1, wherein the support structure is comprised of at least two parts, one of the at least two parts has at least one slot and another of the at least two parts has at least one pin that slides in the at least one slot to move one adapter in closer proximity to the other adapter.

7. A transfer guard according to claim 1, wherein the support structure is comprised of at least two parts that slide together to move one adapter in closer proximity to the other adapter.

8. A transfer guard according to claim 1, wherein the locking mechanism engages when the adapters are moved from a first more distant position relative to each other to a second closer position relative to each other.

9. A transfer guard according to claim 1, wherein the needle has two ends and wherein each end of the needle extends into a container when the containers are mated with the adapters and the adapters are moved from a first more distant position relative to each other to a second closer position relative to each other.

10. A transfer guard according to claim 1, wherein the transfer guard is free of a septum.

11. A transfer guard for use by an individual for transferring contents from a supply container to a receiver container that accepts the contents, the transfer guard comprising:

a supply adapter that is adapted to be mated with the supply container;

a receiver adapter that is adapted to be mated with the receiver container;

a support structure coupled between the supply adapter and the receiver adapter to support the supply adapter and the receiver adapter;

a locking mechanism engagable to substantially limit the supply adapter and receiver adapter from moving relative to each other; and a fluid conducting element that provides fluid communication through the supply adapter and the receiver adapter, wherein the fluid conducting element provides a passage for the contents to transfer from the supply container into the receiver container, wherein the fluid conducting element includes at least one end that is substantially protected by the adapters from contact with the individual, and wherein the at least one end is exposed to the air after the containers are mated with the adapters and before the transfer guard is compressed.

12. A transfer guard according to claim 11, wherein the fluid transfer conduit is a needle and wherein the needle is attached to one of the adapters for support.

13. A transfer guard for use by an individual for transferring contents from a supply container through a fluid conducting element to a receiver container that accepts the contents, wherein the fluid conducting element is protected from contact with the individual, the transfer guard comprising:

a supply adapter that is adapted to be mated with the supply container;

a receiver adapter that is adapted to be mated with the receiver container;

a locking mechanism engagable to substantially limit the supply adapter and receiver adapter from moving relative to each other; and a support structure coupled between the supply adapter and the receiver adapter to support the supply adapter and the receiver adapter, wherein the support structure facilitates movement of the adapters from a first more distant position between the adapters to a second closer position between the adapters, and wherein the support structure includes hinges that fold to move one adapter in closer proximity to the other adapter.

14. A transfer guard according to claim 13, further including a locking mechanism that may be engaged to keep the adapters from moving apart from each other.

15. A transfer guard for use by an individual for transferring contents from a supply container to a receiver container that accepts the contents, the transfer guard comprising:

a supply adapter that is adapted to be mated with the supply container;

a receiver adapter that is adapted to be mated with the receiver container;

a support structure coupled between the supply adapter and the receiver adapter to support the supply adapter and the receiver adapter;

a locking mechanism engagable to substantially limit the supply adapter and receiver adapter from moving relative to each other; and a needle that passes through the supply adapter and the receiver adapter, wherein the needle is attached to one of the adapters for support, wherein the needle provides a passage for the contents to transfer from the supply container through both of the adapters into the receiver container, wherein the needle includes at least one point that is substantially protected by the adapters from contact with the individual, and wherein the support structure includes hinges that fold to move the adapters in closer proximity to each other.

16. A transfer guard for use by an individual for transferring contents from a supply container to a receiver container that accepts the contents, the transfer guard comprising:

a supply adapter that is adapted to be mated with the supply container;

a receiver adapter that is adapted to be mated with the receiver container;

a support structure coupled between the supply adapter and the receiver adapter to support the supply adapter and the receiver adapter, wherein the support structure includes bands that bend to move one adapter in closer proximity to the other adapter; and a needle that passes through the supply adapter and the receiver adapter, wherein the needle is attached to one of the adapters for support, wherein the needle provides a passage for the contents to transfer from the supply container through both of the adapters into the receiver container, and wherein the needle includes at least one point that is substantially protected by the adapters from contact with the individual.

17. A transfer guard for use by an individual for transferring contents from a supply container to a receiver container that accepts the contents, the transfer guard comprising:

a supply adapter that is adapted to be mated with the supply container;

a receiver adapter that is adapted to be mated with the receiver container;

a support structure coupled between the supply adapter and the receiver adapter to support the supply adapter and the receiver adapter;

a locking mechanism engagable to substantially limit the supply adapter and receiver adapter from moving relative to each other; and a needle that passes through the supply adapter and the receiver adapter, wherein the needle is attached to one of the adapters for support, wherein the needle provides a passage for the contents to transfer from the supply container through both of the adapters into the receiver container, wherein the needle includes at least one point that is substantially protected by the adapters from contact with the individual, and wherein the locking mechanism includes locking arms engagable to keep the adapters from moving apart.

18. A transfer guard for use by an individual for transferring contents from a supply container to a receiver container that accepts the contents, the transfer guard comprising:

a supply adapter that is adapted to be mated with the supply container;

a receiver adapter that is adapted to be mated with the receiver container;

a support structure coupled between the supply adapter and the receiver adapter to support the supply adapter and the receiver adapter;

a locking mechanism engagable to substantially limit the supply adapter and receiver adapter from moving relative to each other; and a needle that passes through the supply adapter and the receiver adapter, wherein the needle is attached to one of the adapters for support, wherein the needle provides a passage for the contents to transfer from the supply container through both of the adapters into the receiver container, wherein the needle includes at least one point that is substantially protected by the adapters from contact with the individual, and wherein the needle has two ends and wherein each end has a point.

* * * * *